US009384749B2

(12) United States Patent
Kawashima et al.

(10) Patent No.: US 9,384,749 B2
(45) Date of Patent: Jul. 5, 2016

(54) ENCODING DEVICE, DECODING DEVICE, ENCODING METHOD AND DECODING METHOD

(75) Inventors: Takuya Kawashima, Ishikawa (JP); Katsunori Daimou, Hyogo (JP); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 207 days.

(21) Appl. No.: 14/238,041

(22) PCT Filed: Aug. 24, 2012

(86) PCT No.: PCT/JP2012/005312
§ 371 (c)(1),
(2), (4) Date: Feb. 10, 2014

(87) PCT Pub. No.: WO2013/035257
PCT Pub. Date: Mar. 14, 2013

(65) Prior Publication Data

US 2014/0200901 A1 Jul. 17, 2014

(30) Foreign Application Priority Data

| | | |
|---|---|---|
| Sep. 9, 2011 | (JP) | 2011-197295 |
| Dec. 21, 2011 | (JP) | 2011-279623 |
| Jan. 31, 2012 | (JP) | 2012-019004 |
| Mar. 30, 2012 | (JP) | 2012-079682 |

(51) Int. Cl.

| | |
|---|---|
| ***G10L 21/0388*** | (2013.01) |
| ***G10L 19/26*** | (2013.01) |
| *G10L 19/02* | (2013.01) |

(52) U.S. Cl.
CPC ..... *G10L 19/265* (2013.01); *G10L 21/0388* (2013.01); *G10L 19/0204* (2013.01)

(58) Field of Classification Search
CPC ..... G10L 19/0204; G10L 19/265; G10L 21/0388
See application file for complete search history.

(56) References Cited

U.S. PATENT DOCUMENTS

| | | | | |
|---|---|---|---|---|
| 7,769,584 | B2 | 8/2010 | Oshikiri et al. | |
| 2004/0161116 | A1* | 8/2004 | Tsuji | G10L 19/008 381/22 |

(Continued)

FOREIGN PATENT DOCUMENTS

| | | |
|---|---|---|
| CN | 1691710 | 11/2005 |
| CN | 1950686 | 4/2007 |

(Continued)

OTHER PUBLICATIONS

English translation of China Office action dated Jul. 21, 2015.

(Continued)

*Primary Examiner* — King Poon
*Assistant Examiner* — Ibrahim Siddo
(74) *Attorney, Agent, or Firm* — Greenblum & Bernstein P.L.C.

(57) ABSTRACT

By copying to a high-frequency band portion (extension band) a low-frequency band portion in which peaking has been set to a sufficiently low state, this encoding device is capable of preventing generation of a spectrum with overly high peaking in the high-frequency band portion, and of generating a high-quality extension band spectrum. This device comprises: a maximum value search unit which searches, in each of multiple sub-bands obtained by dividing the low-frequency band portion of an audio signal and/or music signal below a prescribed frequency, for the maximum value of the amplitude of a first spectrum obtained by decoding first encoded data, which is encoded data in the low-frequency band portion; and an amplitude normalization unit which obtains a normalized spectrum by normalizing, at the maximum values of the amplitude of each sub-band, the first spectrum contained in each sub-band.

6 Claims, 23 Drawing Sheets

(56) References Cited

U.S. PATENT DOCUMENTS

| | | | | |
|---|---|---|---|---|
| 2004/0176961 | A1 | 9/2004 | Manu et al. | |
| 2006/0251178 | A1 | 11/2006 | Oshikiri | |
| 2007/0071116 | A1* | 3/2007 | Oshikiri | G10L 21/038 375/260 |
| 2008/0052066 | A1* | 2/2008 | Oshikiri | G10L 21/038 704/221 |
| 2009/0094024 | A1 | 4/2009 | Yamanashi et al. | |
| 2009/0271204 | A1 | 10/2009 | Tammi | |
| 2010/0017198 | A1 | 1/2010 | Yamanashi et al. | |
| 2010/0138219 | A1 | 6/2010 | Oshikiri | |

FOREIGN PATENT DOCUMENTS

| | | |
|---|---|---|
| CN | 101048814 | 10/2007 |
| EP | 2018069 | 1/2009 |
| JP | 2004-206129 | 7/2004 |
| JP | 2005-080063 | 3/2005 |
| JP | 2009-515212 | 4/2009 |
| WO | 2005/027095 | 3/2005 |
| WO | 2007/052088 | 5/2007 |
| WO | 2007/105586 | 9/2007 |
| WO | 2007/129423 | 11/2007 |
| WO | 2008/072737 | 6/2008 |
| WO | 2010/021804 | 2/2010 |

OTHER PUBLICATIONS

Martin Dietz et al., "Spectral Band Replication, a novel approach in audio coding", Convention Paper 5553, Audio Engineering Society, May 2002, pp. 1-8.

International Telecommunication Union, "ITU-T Standard G.729.1, Amendment 6, New Annex E", 2006.

International Telecommunication Union, "ITU-T Standard G.718, Amendment 2, New Annex B", 2008.

International Search Report in PCT/JP2012/005312, mailed on Dec. 11, 2012.

* cited by examiner

ENCODING DEVICE, DECODING DEVICE, ENCODING METHOD AND DECODING METHOD

TECHNICAL FIELD

The present invention relates to a coding apparatus, a decoding apparatus, a coding method and a decoding method.

BACKGROUND ART

Patent Literature (hereinafter, referred to as "PTL") 1 discloses a technique that enables efficient encoding of speech signals or music signals in a super-wide band (SWB) (typically, 0.05 to 14 kHz band). This technique has been standardized by ITU-T (see, for example, NPL1 and NPL2). In this technique, a low band part (a band of, for example, up to 7 kHz) of an input signal such as a speech signal or a music signal is encoded by a core coding section while a high band part (a band higher than, for example, 7 kHz) is encoded by an extension band coding section.

In general, the core coding section uses CELP (code excited linear prediction) coding. Meanwhile, the extension band coding section performs encoding in the frequency domain using information encoded by the core coding section. More specifically, the extension band coding section uses a spectrum (decoded low band spectrum) obtained as a result of decoding a narrowband signal in the low band part (not higher than 7 kHz) encoded by the core coding section and transforming the decoded narrow-band signal into MDCT (modified discrete cosine transform) coefficients (spectrum), for encoding for the high band part (a band higher than 7 kHz; hereinafter referred to as "extension band").

At the time of encoding for the extension band, first, the decoded low band spectrum generated by the core coding section is normalized using a spectrum power envelope (hereinafter referred to as "envelope"). More specifically, the low band part including the decoded low band spectrum is divided into a plurality of sub-bands, and energy (sub-band energy) is calculated for each sub-band. Next, the sub-band energy is smoothened in order to smooth energy fluctuations in the frequency domain. Next, a spectrum included in each sub-band is normalized using the smoothened sub-band energy. The extension band coding section makes a search to find bands that are highly correlated with each other from the spectrum (normalized spectrum) obtained as described above and an extension band spectrum in the input signal and encodes information indicating the highly-correlated bands as a lag. Also, the extension band coding section copies the highly-correlated band in the low band part to the extension band in order to use the highly-correlated band in the low band part as a spectrum fine structure (frequency-based fine structure) in the extension band. Then, the extension band coding section calculates a gain between the spectrum fine structure and the extension band spectrum and encodes the gain.

As a result of the above processing being performed, an extension band spectrum is generated from a low band spectrum.

The reason for normalizing the low band spectrum when an extension band spectrum is generated from a low band spectrum in an input signal is as follows. In general, a low band spectrum has very large energy bias, and a high band, i.e., extension band, spectrum has small energy bias. In other words, in the high band part, high peaks are less likely to appear locally compared to the low band part, and thus, copying a signal having a high peaking property to the high band part (extension band) may result in sound quality deterioration. Therefore, in a coding apparatus, a low band spectrum is normalized because encoding can be performed more efficiently when correlation between the low band spectrum and an extension band spectrum is calculated after energy bias in the low band spectrum is removed to flatten (normalize) the low band spectrum.

NPL 3 discloses a related technique in which transform coding is used in a core coding section. In this related technique, an MPEG (Moving Picture Experts Group) AAC (Advanced Audio Coding) method is used in the core coding section. Also, extension band coding is performed using a SBR (spectral band replication) method, which is different from the extension band coding method described above.

CITATION LIST

Patent Literature

PTL1
Japanese Translation of PCT Application Laid-Open No. 2009-515212

Non-Patent Literature

NPL1
ITU-T Standard G.718 Annex B, 2008
NPL2
ITU-T Standard G.729.1 Annex E, 2008
NPL3
Martin Dietz, Lars Liljeryd, Kristofer Kjörling, Oliver Kunz, "Spectral Band Replication, a novel approach in audio coding," Preprint 5553, 112th AES Convention, Munich, 2002.

SUMMARY OF INVENTION

Technical Problem

In NPL 1 and NPL 2, CELP coding is used in the core coding section. CELP coding has the advantage of enabling very efficient speech signal coding and providing excellent coding performance, but has the disadvantage of having insufficient music signal coding performance.

However, in order to encode an SWB signal with a sampling rate of 32 kHz, it is necessary to enhance the music signal encoding performance. In this case, in the core coding section, transform coding may be used instead of CELP coding. In general, in transform coding, a spectrum is encoded using a limited number of pulses, and thus, the low band spectrum will be expressed by a discrete pulse train.

If such spectrum expressed by a discrete pulse train is segmented into sub-bands and energy in each sub-band is calculated and smoothened to estimate an envelope as in NPL 1 and NPL 2, parts of the spectrum that are necessary to correctly calculate the energy in each sub-band are insufficient. For this reason, the coding apparatus may estimate an envelope that is different from the shape of an original envelope (that is, the envelope of the input signal). If the coding apparatus performs normalization of the low band spectrum using the incorrect envelope calculated as described above, the spectrum resulting from the normalization is not flat and may include extremely-large amplitudes.

When a spectrum of a speech signal or a music signal is observed, in the high band part, almost no high peaks appear locally compared to the low band part. Thus, if a low band part having a high peaking property is copied to a high band part, a spectrum having an excessively-high peaking property is generated in the high band part, resulting in sound quality deterioration. As described above, a low band spectrum having no flat characteristic may adversely affect the quality of sound in the extension band, which is generated using the low band spectrum.

An object of the present invention is to provide a coding apparatus, a decoding apparatus, a coding method and a decoding method that copy a low band part having a sufficiently-lowered peaking property to a high band part (extension band) to prevent generation of a spectrum having an excessively-high peaking property in the high band part, thus enabling generation of a high-quality extension band spectrum.

Solution to Problem

A coding apparatus according to an aspect of the present invention includes: a first coding section that encodes a low band part of an input signal including at least one of a speech signal and a music signal to generate first encoded data, the low band part being equal to or lower than a predetermined frequency; a normalization section that normalizes a first spectrum to generate a normalized spectrum, the first spectrum being obtained by decoding the first encoded data; a band searching section that makes a search to find a particular band having a largest correlation value between the normalized spectrum and a second spectrum that is a spectrum in a high band part of the input signal, the high band part being higher than the predetermined frequency; a gain calculating section that calculates a gain between the second spectrum and a third spectrum that is a spectrum obtained by copying the normalized spectrum in the particular band to the high band part; and a second coding section that encodes information including the particular band and the gain to generate second encoded data, in which the normalization section includes: a largest value searching section that makes a search to find a largest value in amplitude of the first spectrum in each of a plurality of sub-bands resulting from division of the low band part; and an amplitude normalization section that normalizes the first spectrum included in each of the sub-bands using the largest value in the amplitude of the sub-band to obtain the normalized spectrum.

A coding apparatus according to an aspect of the present invention includes: a transforming section that transforms an input signal including at least one of a speech signal and a music signal into a frequency domain to generate an input signal spectrum; a first bit allocating section that determines a number of bits to be allocated to each of sub-bands resulting from division of an entire band of the input signal spectrum using predetermined bandwidth; a first coding section that encodes the input signal spectrum using the allocated bits to generate first encoded data; a second bit allocating section that determines a number of bits to be allocated to each of sub-bands resulting from division of a spectrum in a low band part of the input signal spectrum using a predetermined bandwidth, the low band part being lower than a predetermined frequency; a second coding section that encodes the spectrum in the low band part of the input signal spectrum using the allocated bits to generate second encoded data, the low band part being lower than the predetermined frequency; a third coding section that encodes a spectrum in a high band part of the input signal spectrum to generate third encoded data, the high band part being higher than the predetermined frequency; a determination section that analyzes a number of bits to be consumed for encoding the spectrum in the high band part of the input signal spectrum to obtain determination information, the high band part being higher than the predetermined frequency; and a switching section that performs switching to select the first coding section alone or a combination of the second coding section and the third coding section to encode the input signal spectrum, according to the determination information, for each frame.

A decoding apparatus according to an aspect of the present invention includes: a first decoding section that receives as input first encoded data generated by encoding a low band part of an input signal including at least one of a speech signal and a music signal in a coding apparatus and that decodes the first encoded data to generate a first spectrum, the low band part being equal to or lower than a predetermined frequency; a normalization section that normalizes the first spectrum to generate a normalized spectrum; and a second decoding section that receives as input the normalized spectrum and second encoded data generated in the coding apparatus and that decodes the second encoded data to generate a second spectrum, in which: the second encoded data contains information indicating a particular band having a largest correlation value between an encoding-side first spectrum that is a spectrum in a high band part of the input signal in the coding apparatus and an encoding-side second spectrum resulting from normalization of a spectrum generated by decoding the first encoded data in the coding apparatus, the high band part being higher than the predetermined frequency, and information indicating a gain calculated between the encoding-side first spectrum and an encoding-side third spectrum that is a spectrum obtained by copying the encoding-side second spectrum in the particular band to the high band part; and the normalization section includes a largest value searching section that makes a search to find a largest value in amplitude of the first spectrum in each of a plurality of sub-bands resulting from division of the low band part, and an amplitude normalization section that normalizes the first spectrum in each of the sub-bands using the largest value in the amplitude of the sub-band to generate the normalized spectrum.

A coding method according to an aspect of the present invention includes: encoding a low band part of an input signal including at least one of a speech signal and a music signal to generate first encoded data, the low band part being equal to or lower than a predetermined frequency; normalizing a first spectrum to generate a normalized spectrum, the first spectrum being obtained by decoding the first encoded data; making a search to find a particular band having a largest correlation value between the normalized spectrum and a second spectrum that is a spectrum in a high band part of the input signal, the high band part being higher than the predetermined frequency; calculating a gain between the second spectrum and a third spectrum that is a spectrum obtained by copying the normalized spectrum in the particular band to the high band part; and encoding information including the particular band and the gain to generate second encoded data, in which, the normalizing of the first spectrum further includes: making a search to find a largest value in amplitude of the first spectrum in each of a plurality of sub-bands resulting from division of the low band part; and normalizing the first spectrum included in each of the sub-bands using the largest value in the amplitude of the sub-band to obtain the normalized spectrum.

A decoding method according to an aspect of the present invention includes: receiving as input first encoded data generated by encoding a low band part of an input signal including at least one of a speech signal and a music signal in a coding apparatus and decoding the first encoded data to generate a first spectrum, the low band part being equal to or lower than a predetermined frequency; normalizing the first spectrum to generate a normalized spectrum; and receiving as input the normalized spectrum and second encoded data generated in the coding apparatus and decoding the second encoded data to generate a second spectrum, in which: the second encoded data contains information indicating a particular band having a largest correlation value between an encoding-side first spectrum that is a spectrum in a high band part of the input signal in the coding apparatus and an encoding-side second spectrum resulting from normalization of a spectrum generated by decoding the first encoded data in the coding apparatus, the high band part being higher than the predetermined frequency, and information indicating a gain calculated between the encoding-side first spectrum and an encoding-side third spectrum that is a spectrum obtained by copying the encoding-side second spectrum in the particular band to the high band part; and the normalizing of the first spectrum to generate a normalized spectrum further includes making a search to find a largest value in amplitude of the first spectrum in each of a plurality of sub-bands resulting from division of the low band part, and normalizing the first spectrum in each of the sub-bands using the largest value in the amplitude of the sub-band to generate the normalized spectrum.

Advantageous Effects of Invention

According to the present invention, a low band part having a sufficiently-lowered peaking property is copied to a high band part (extension band) to prevent generation of a spectrum having an excessively-high peaking property in the high band part, which in turn, enables generation of a high-quality extension band spectrum.

DESCRIPTION OF EMBODIMENTS

In the present invention, in a codec with which a coding apparatus that generates a spectrum in an extension band (extension band spectrum) using a spectrum in a low band part (low band spectrum), the low band spectrum is divided into a plurality of sub-bands and the spectrum in each sub-band is normalized using a largest value in amplitude of the spectrum included in the sub-band. Consequently, even if the low band spectrum is a discrete spectrum, generation of an extremely-large amplitude in the low band spectrum is prevented, which in turn, enables provision of a flat normalized low band spectrum. Consequently, the coding apparatus copies the low band part having a sufficiently-lowered peaking property to the extension band, preventing generation of a spectrum having an excessively-high peaking property in the extension band, enabling generation of an extension band spectrum of high quality sound.

Each embodiment of the present invention will be described below with reference to the accompanying drawings. The coding apparatus and decoding apparatus according to the present invention cover any of speech signals, music signals and signals that are mixtures thereof, as input/output signals.

Embodiment 1

Figure 1:
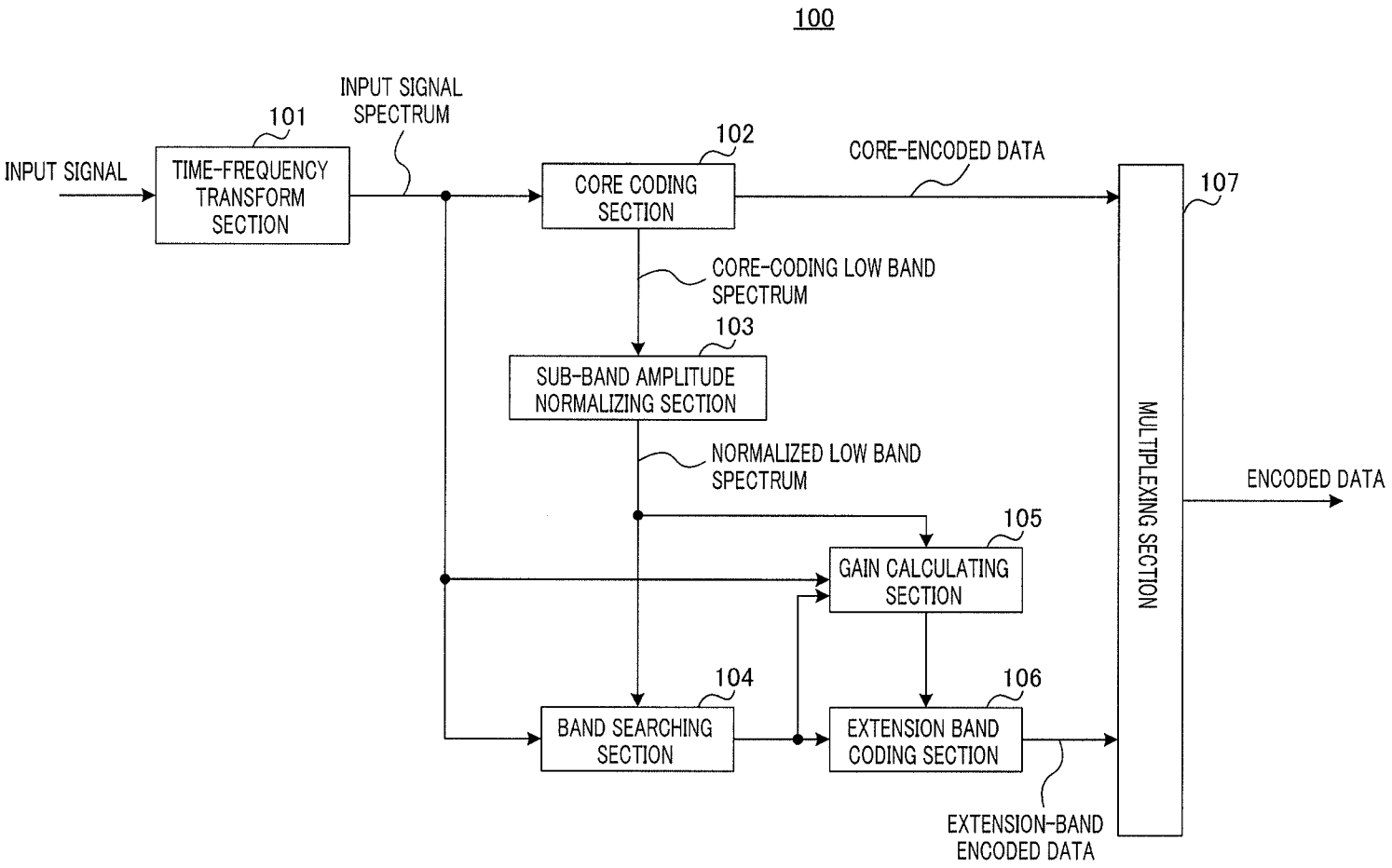
FIG. 1 is a block diagram illustrating a configuration of a coding apparatus according to Embodiment 1 of the present invention.

FIG. 1 is a block diagram illustrating a configuration of coding apparatus 100 according to Embodiment 1.

Coding apparatus 100 in FIG. 1 includes time-frequency transform section 101, core coding section 102, sub-band amplitude normalizing section 103, band searching section 104, gain calculating section 105, extension band coding section 106 and multiplexing section 107. In the present embodiment, core coding section 102 encodes a low band part (low band spectrum) of an input spectrum that is input to coding apparatus 100, the low band part being of a frequency equal to or lower than a predetermined frequency, and extension band coding section 106 encodes a spectrum in a high band of the input spectrum, the high band being higher than the band subjected to the encoding by core coding section 102 (band higher than the predetermined frequency; hereinafter referred to as "extension band").

Time-frequency transform section 101 transforms an input time-domain signal (including a speech signal or/and a music signal) into a frequency-domain signal and outputs a spectrum of the resulting input signal to core coding section 102, band searching section 104 and gain calculating section 105. Here, the below description will be given on the premise that MDCT is employed for time-frequency transform processing in time-frequency transform section 101. However, time-frequency transform section 101 may use an orthogonal transform such as FFT (fast Fourier transform) or DCT (discrete cosine transform) for transform from the time domain to the frequency domain.

Core coding section 102 encodes a low band spectrum in the input signal spectrum input from time-frequency transform section 101 to generate encoded data. Core coding section 102 performs the encoding using transform coding. Core coding section 102 outputs the generated encoded data to multiplexing section 107 as core-encoded data. Also, core coding section 102 outputs a core-coding low band spectrum obtained by decoding the core-encoded data, to sub-band amplitude normalizing section 103.

Sub-band amplitude normalizing section 103 normalizes the core-coding low band spectrum received as input from core coding section 102 to generate a normalized low band spectrum. More specifically, sub-band amplitude normalizing section 103 divides the core-coding low band spectrum into a plurality of sub-bands, and a spectrum in each sub-band is normalized using a largest value in amplitude (absolute value) of the spectrum in the sub-band. Sub-band amplitude normalizing section 103 outputs a normalized low band spectrum obtained as a result of the normalization processing to band searching section 104 and gain calculating section 105. Details of a configuration and operation of sub-band amplitude normalizing section 103 will be described later.

Band searching section 104, gain calculating section 105 and extension band coding section 106 perform processing for encoding a spectrum in the extension band of the input signal spectrum (input extension band spectrum).

Band searching section 104 makes a search to find particular bands in the input signal spectrum input from time-frequency transform section 101, the particular bands having a largest value of correlation between the input extension band spectrum, and the normalized low band spectrum input from sub-band amplitude normalizing section 103. Then, band searching section 104 outputs information indicating the found particular bands (the relevant band in the normalized low band spectrum (copy source) and the relevant band in the extension band (copy destination)) (referred to as lag or lag information) to gain calculating section 105 and extension band coding section 106.

Figure 2:
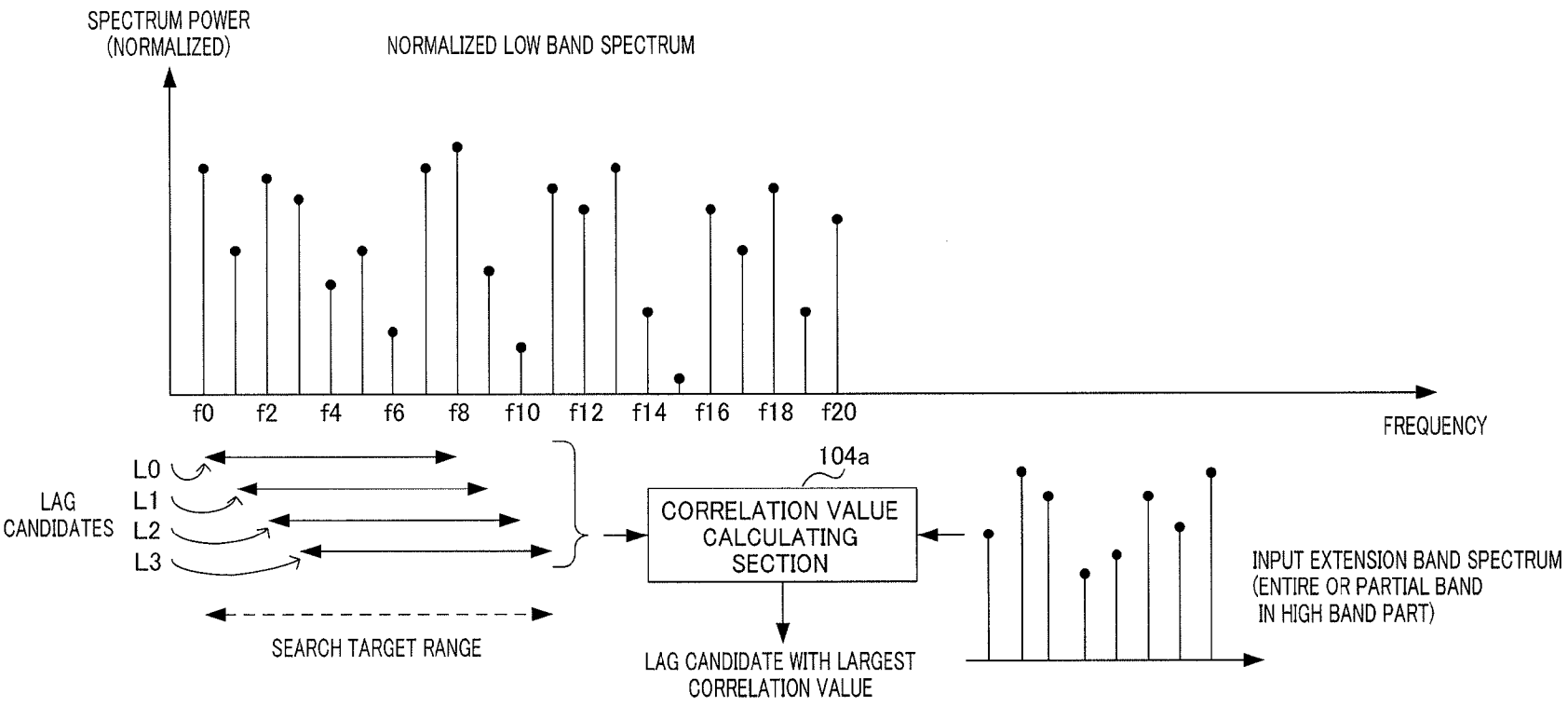
FIG. 2 is a diagram illustrating how a band searching section in the coding apparatus according to Embodiment 1 of the present invention operates.

FIG. 2 is a diagram illustrating how band searching section 104 operates. In band searching section 104, a spectrum corresponding to each of lag candidates provided in advance (as an example, four candidates of L0 to L3 in FIG. 2) is extracted from the input normalized low band spectrum. The spectrum to be extracted is a spectrum with a starting point located at a position shifted from reference frequency f0 by a given sample value expressed by the lag candidate, the spectrum having a bandwidth that is the same as that of the input extension band spectrum (entirety or part of the extension band). The extracted spectrum is output to correlation value calculating section **104*a*** as a candidate spectrum for correlation value calculation. In this example, four types of candidate spectrums are subject to correlation value calculation.

Correlation value calculating section **104*a* calculates a correlation value between each of the candidate spectrums identified according to the respective lag candidates and the input extension band spectrum and outputs a lag candidate exhibiting a highest correlation value in the correlation values to gain calculating section 105 and extension band coding section 106** as information indicating the particular bands.

Gain calculating section 105 determines a spectrum obtained as a result of copying the normalized low band spectrum in the relevant particular band found as a result of the search in band searching section 104 to the extension band, as a spectrum fine structure (frequency-based fine structure). Then, gain calculating section 105 calculates a gain between the obtained spectrum fine structure and the input extension band spectrum received as input from time-frequency transform section 101. Gain calculating section 105 outputs information indicating the calculated gain to extension band coding section 106. Gain calculating section 105 basically calculates a gain so that energy of a signal copied from a normalized low band spectrum corresponds to (or is close to) energy in the extension band of the input signal spectrum. Examples of the simplest gain calculation method include a method in which energy in an extension band of an input signal spectrum is divided by energy of a signal copied from a normalized low band spectrum and the square root of the value obtained as a result of the division is employed as a gain.

Extension band coding section 106 encodes the information indicating the particular bands, which is input from band searching section 104, and also encodes the gain input from gain calculating section 105. Extension band coding section 106 outputs encoded data generated as a result of encoding the particular bands and the gain to multiplexing section 107 as extension-band encoded data.

Multiplexing section 107 multiplexes the core-encoded data received as input from core coding section 102 and extension-band encoded data received as input from extension band coding section 106 and outputs the resulting encoded data.

Figure 3:
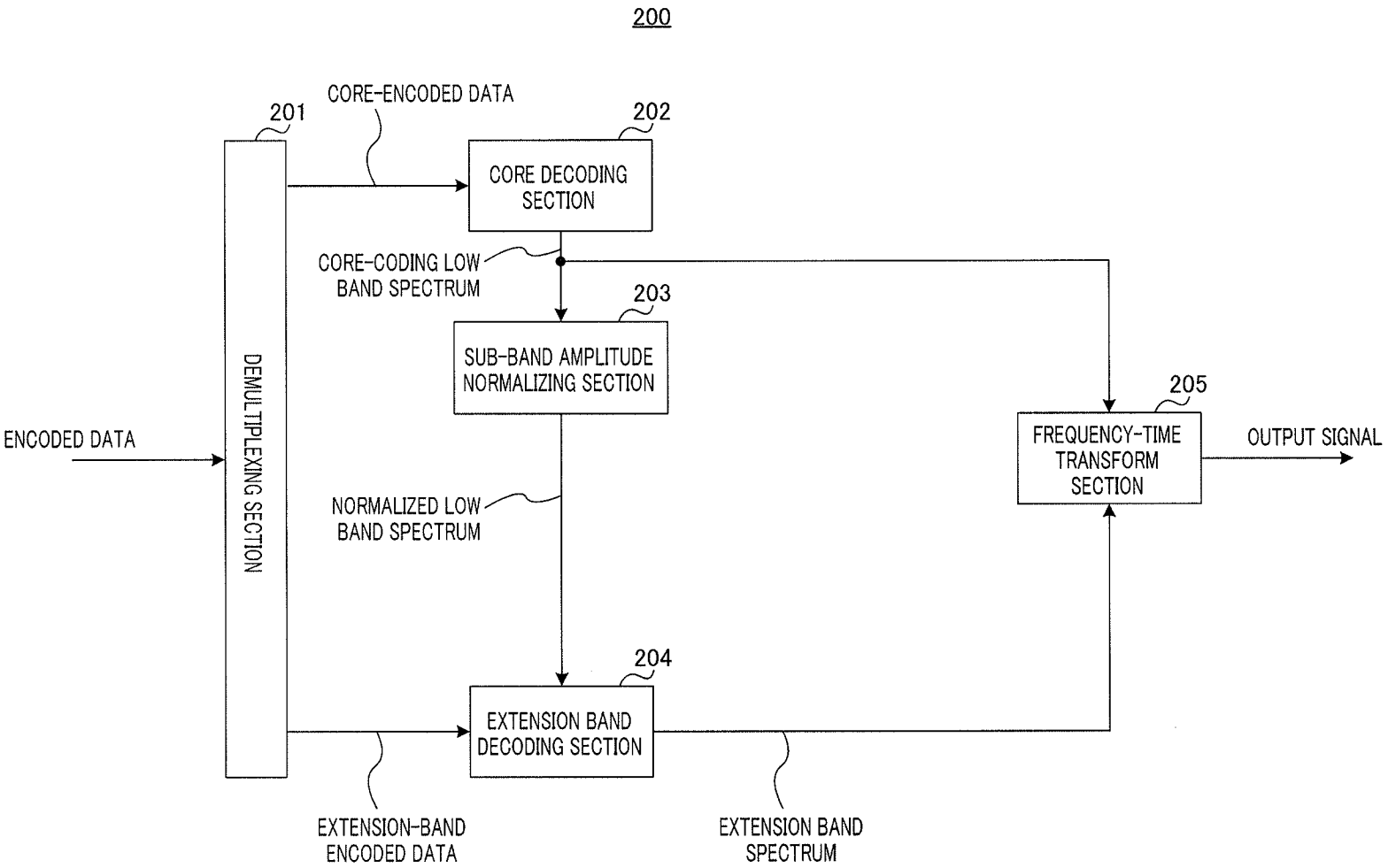
FIG. 3 is a block diagram illustrating a configuration of a decoding apparatus according to Embodiment 1 of the present invention.

Next, decoding apparatus 200 according to the present embodiment will be described. FIG. 3 is a block diagram illustrating a configuration of decoding apparatus 200.

Decoding apparatus 200 illustrated in FIG. 3 includes demultiplexing section 201, core decoding section 202, sub-band amplitude normalizing section 203, extension band decoding section 204 and frequency-time transform section 205.

Demultiplexing section 201 separates encoded data received as input into core-encoded data and extension-band encoded data. Demultiplexing section 201 outputs the core-encoded data to core decoding section 202 and outputs the extension-band encoded data to extension band decoding section 204.

As described above, core-encoded data is encoded data obtained as a result of encoding a low band part of an input signal (including a speech signal or/and a music signal), the low band part being not higher than a predetermined frequency, being encoded in coding apparatus 100. Also, extension-band encoded data contains: information indicating particular bands having a largest correlation value between a spectrum (input extension band spectrum) of a high band part in an input signal (including a speech signal or/and a music signal), the high band part being higher than the predetermined frequency, and a normalized spectrum; and information indicating a gain between a spectrum obtained as a result of copying the normalized spectrum in the relevant particular band to the high band part (spectrum fine structure) and the input extension band spectrum.

Core decoding section 202 decodes the core-encoded data received as input from demultiplexing section 201 to generate a core-coding low band spectrum. Core decoding section 202 outputs the generated core-coding low band spectrum to sub-band amplitude normalizing section 203 and frequency-time transform section 205.

Sub-band amplitude normalizing section 203 normalizes the core-coding low band spectrum received as input from core decoding section 202 to generate a normalized low band spectrum. Sub-band amplitude normalizing section 203 outputs the generated normalized low band spectrum to extension band decoding section 204. The configuration and operation of sub-band amplitude normalizing section 203 are the same as those of sub-band amplitude normalizing section 103 illustrated in FIG. 1, which will be described later, so that a detailed description thereof will be omitted.

Extension band decoding section 204 performs decoding processing using the normalized low band spectrum received as input from sub-band amplitude normalizing section 203 and the extension-band encoded data received as input from demultiplexing section 201 to obtain an extension band spectrum. Extension band decoding section 204 decodes the extension-band encoded data to obtain lag information and a gain. Extension band decoding section 204 identifies a predetermined band in the normalized low band spectrum, which is to be copied to the extension band, based on the lag information, and copies the predetermined band in the normalized low band spectrum to the extension band. Next, extension band decoding section 204 multiplies a spectrum resulting from the predetermined band in the normalized low band spectrum being copied to the extension band, by the decoded gain to obtain the extension band spectrum. Then, extension band decoding section 204 outputs the obtained extension band spectrum to frequency-time transform section 205.

Figure 4:
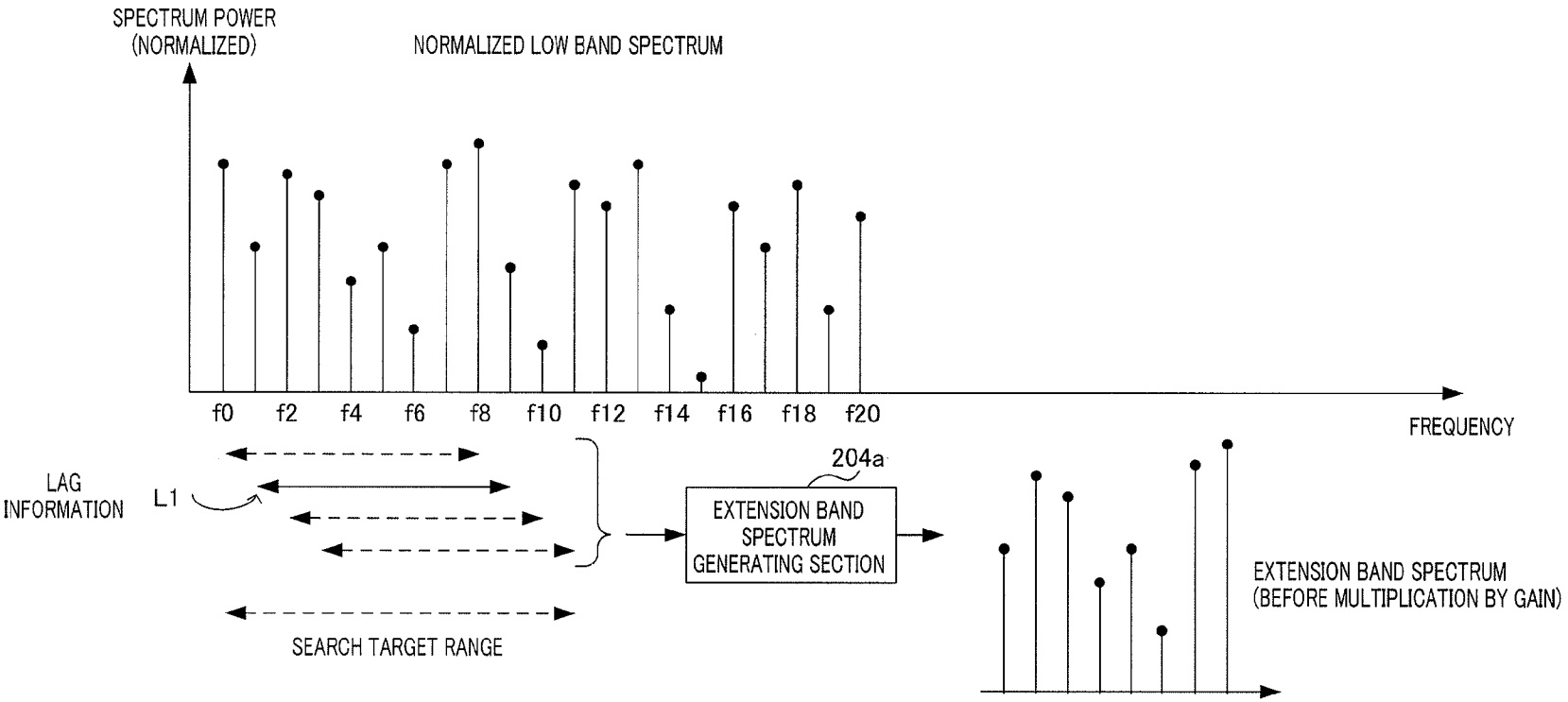
FIG. 4 is a diagram illustrating how an extension band decoding section in the decoding apparatus according to Embodiment 1 of the present invention operates.

FIG. 4 is a diagram illustrating how extension band decoding section 204 operates. Extension band decoding section 204 first determines a starting point of a normalized low band spectrum used for copy to the extension band, based on the lag information. Since FIG. 4 indicates an example where lag information L1 is obtained, the starting point of the normalized low band spectrum is located at f1.

Next, extension band spectrum generating section 204*a* in extension band decoding section 204 extracts a spectrum included in a bandwidth that is the same as that of an input extension band spectrum (entirety or part of the extension band), from the starting point to generate an extension band spectrum (before multiplication by the gain).

Frequency-time transform section 205 first combines the core-coding low band spectrum input from core decoding section 202 and the extension band spectrum input from extension band decoding section 204 to generate a decoded spectrum. Next, frequency-time transform section 205 performs an orthogonal transform of the decoded spectrum to transform the decoded spectrum into a time-domain signal and outputs the time-domain signal as an output signal.

Next, a configuration and operation of sub-band amplitude normalizing section 103 in coding apparatus 100 will be described in detail below.

Sub-band amplitude normalizing section 103 removes energy bias in the core-coding low band spectrum received as input from core coding section 102 to obtain a normalized low band spectrum. Here, in order to remove energy bias in a spectrum, in general, the spectrum is normalized by calculating an envelope of the spectrum and spectrum parts in each band are divided by a representative value in the envelope for the band. In NPL 1 and NPL 2, also, a low band spectrum is normalized using a technique that is similar to the above.

However, in a case where core coding section 102 uses transform coding and a low bit rate is provided, a low band spectrum is expressed by a discrete pulse train. It is difficult to obtain a correct envelope from a discrete pulse train representing a low band spectrum. Thus, if a low band spectrum is normalized using such incorrect envelope obtained from the low band spectrum, the energy bias remains in the normalized low band spectrum, resulting in the problem of a spectrum part having an extremely-large amplitude remaining in the spectrum. If a search is made to find a band having a large correlation value between such normalized low band spectrum and an input extension band spectrum to copy a part of the normalized low band spectrum in the band having the large correlation value to an extension band, a signal having a high peaking property, which is intrinsically not generated in the extension band (high band part), is generated on the high band side, resulting in substantial sound quality deterioration.

Therefore, in the present embodiment, as a method for removing energy bias, sub-band amplitude normalizing section 103 calculates a largest amplitude value in absolute value of the low band spectrum in each sub-band (hereinafter referred to as "sub-band largest value") and the spectrum in each sub-band is normalized using the sub-band largest value calculated in the sub-band. Consequently, the largest values in absolute value of the spectrums in respective sub-bands after the normalization sub-band become uniform throughout the sub-bands. Consequently, no spectrum part having an extremely-large amplitude exists in the normalized low band spectrum.

Figure 5:
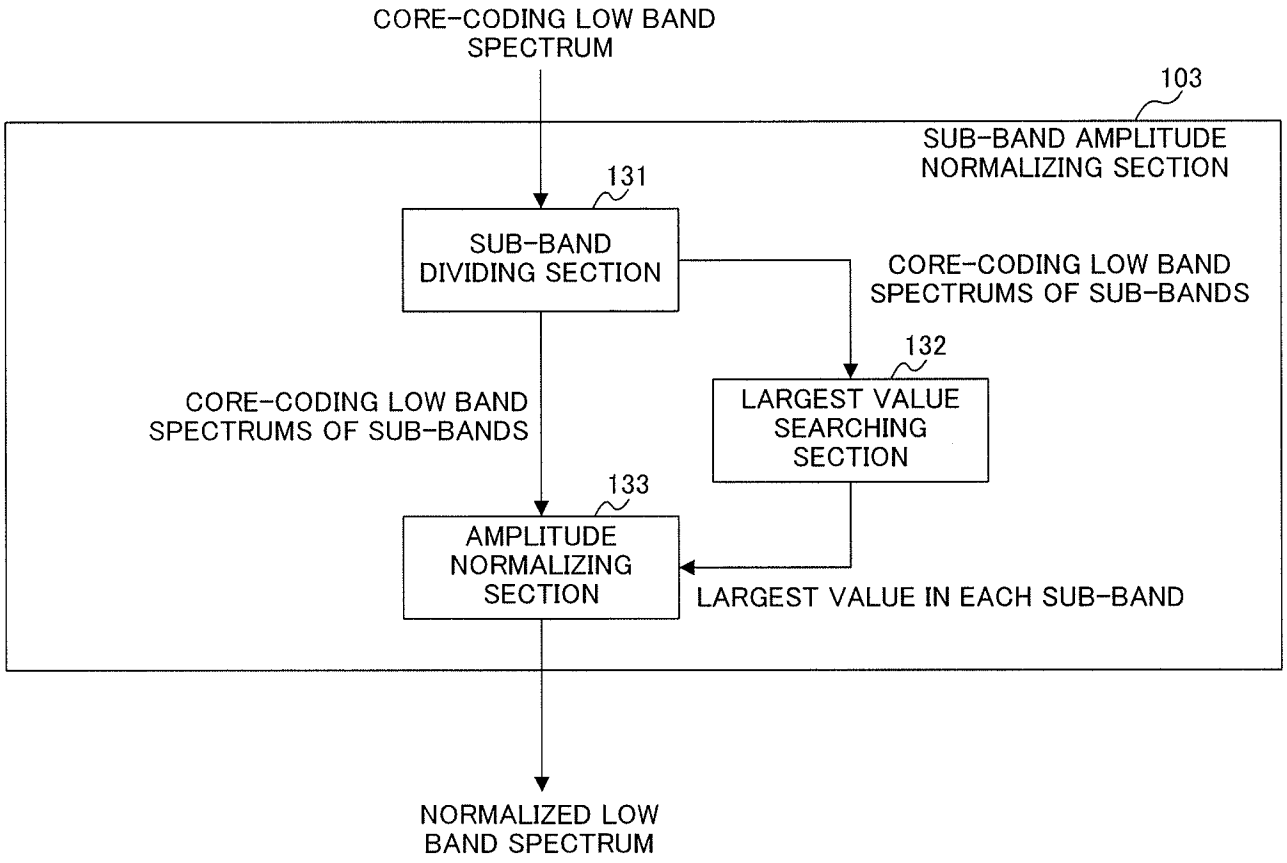
FIG. 5 is a block diagram illustrating an internal configuration of a sub-band amplitude normalizing section according to Embodiment 1 of the present invention.

FIG. 5 illustrates a configuration of sub-band amplitude normalizing section 103 that provides the above processing. Sub-band amplitude normalizing section 103 illustrated in FIG. 5 includes sub-band dividing section 131, largest value searching section 132 and amplitude normalizing section 133.

Sub-band dividing section 131 divides a band including a core-coding low band spectrum input from core coding section 102 (that is, a low band part) into a plurality of sub-bands and outputs the spectrum in each of the obtained sub-bands to largest value searching section 132 and amplitude normalizing section 133 as a sub-band divisional core-coding low band spectrum. For simplicity, a case where sub-band dividing section 131 divides an entire band of a core-coding low band spectrum at even intervals will be described below. Also, in the below description, "w" represents a bandwidth (sample count) of each sub-band. For example, one sub-band may include eight samples (w=8).

Largest value searching section 132 makes a search to find a largest value in amplitude (absolute value) of the sub-band divisional core-coding low band spectrum input from sub-band dividing section 131 in each of the plurality of sub-bands (that is, a sub-band largest value in each sub-band). Largest value searching section 132 outputs the sub-band largest value in each sub-band to amplitude normalizing section 133. Hereinafter, M[j] is used to represent a j-th core-coding low band spectrum, S is used to represent the number of sub-bands and "s" represents a sub-band index. In this case, sub-band largest value Mmax[s] in sub-band s can be expressed by Equation (1) below.

[1]

$$Mmax[s]=\max(\mathrm{abs}(M[j])), w*(s-1)<j<w*s,\ 1\le s\le S \quad \text{(Equation 1)}$$

Amplitude normalizing section 133 normalizes the sub-band divisional core-coding low band spectrums input from sub-band dividing section 131 using the sub-band largest values in the respective sub-bands, which have been received from largest value searching section 132, to obtain a normalized low band spectrum. In other words, amplitude normalizing section 133 normalizes the sub-band divisional core-coding low band spectrums in the respective sub-bands using the sub-band largest values in the sub-bands, respectively. For example, normalized low band spectrum Mn can be expressed by Equation 2 below.

[2]

$$Mn[j] = \frac{M[j]}{(M\max[s]+\varepsilon)}, \quad \text{(Equation 2)}$$
$$w*(s-1) < j < w*s,\ 1 \le s \le S$$

In Equation 2, $\epsilon$ represents a minimal value to avoid division by zero. Amplitude normalizing section 133 can perform the above processing for each of the sub-bands to obtain a normalized low band spectrum.

Next, the operation of sub-band amplitude normalizing section 103 described above will be described with reference to FIGS. 6, 7 and 8.

Figure 6:
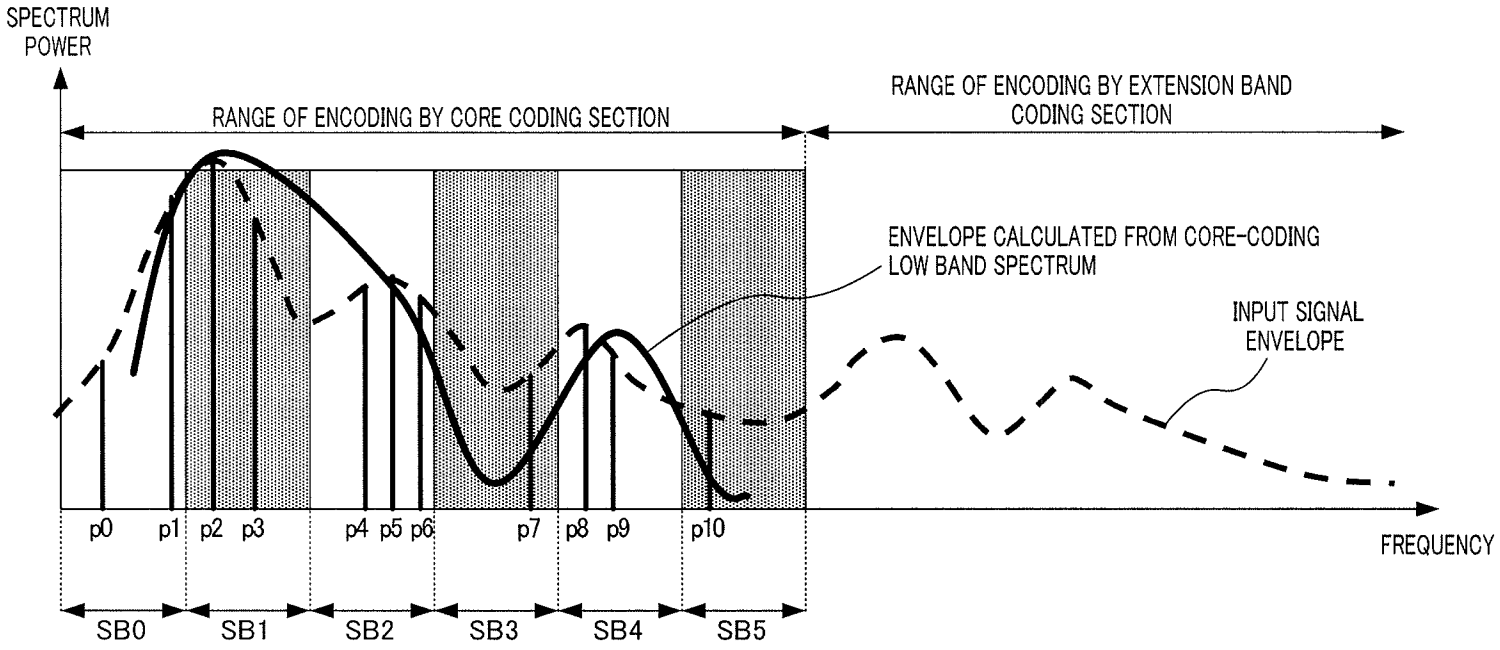
FIG. 6 is a diagram illustrating envelope calculation processing according to the related art.

FIG. 6 illustrates an example of envelope calculation processing in the related art. In FIG. 6, the abscissa axis represents frequency and the ordinate axis represents spectrum power. In FIG. 6, a band (low band part) that is subject to encoding (range of encoding) by a core coding section is divided into six sub-bands SB0 to SB5. In other words, a band (extension band) that is higher than SB5 in FIG. 6 is subject to encoding (range of encoding) by an extension band coding section. Also, the curved dashed line in FIG. 6 indicates an envelope of an input signal spectrum (input signal envelope).

Figure 7:
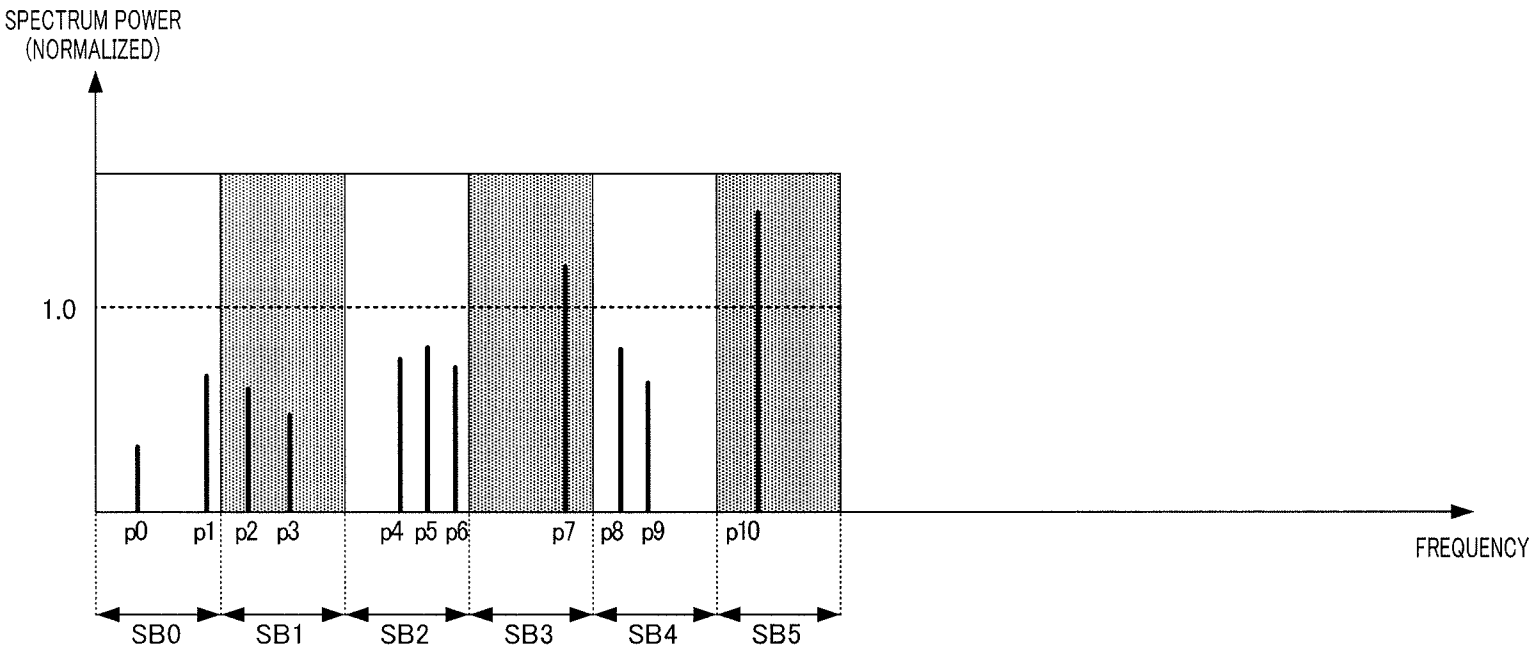
FIG. 7 is a diagram illustrating a normalized low band spectrum according to the related art.
Figure 8:
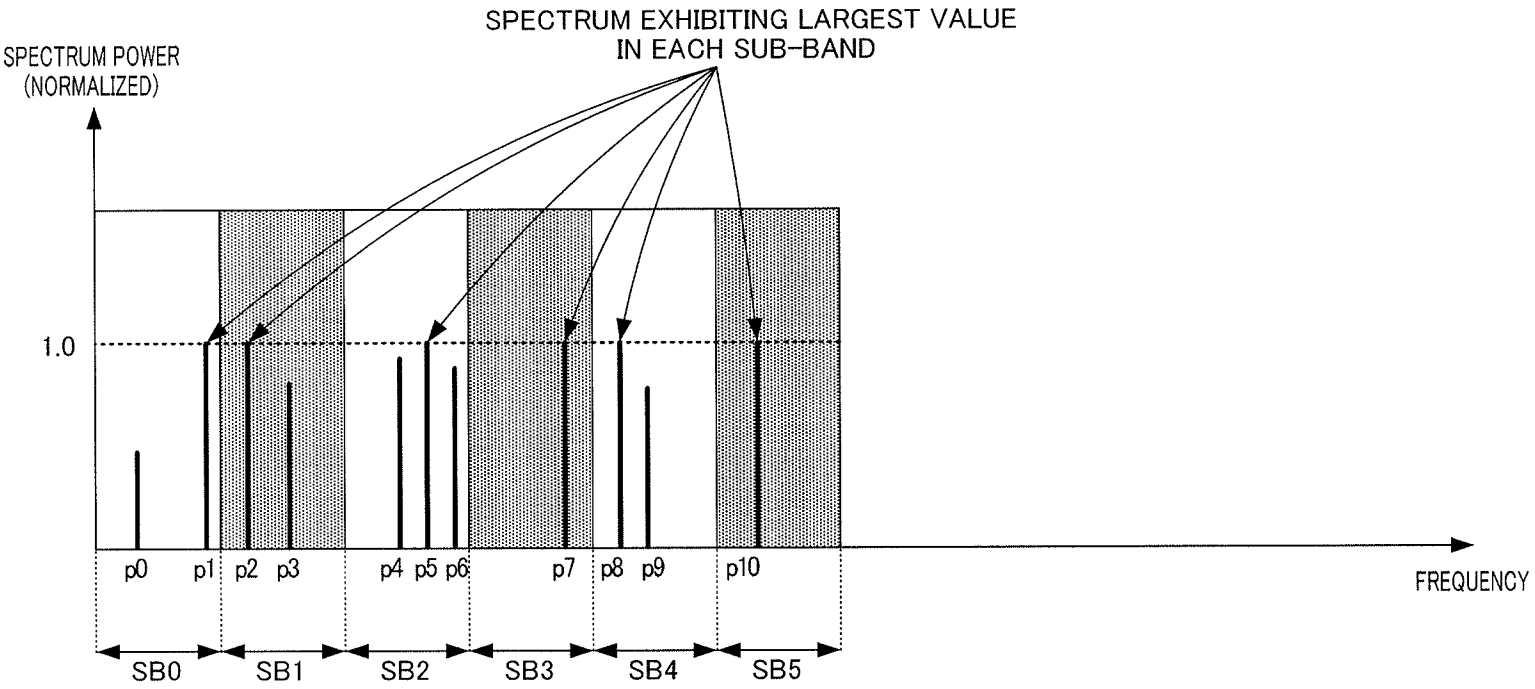
FIG. 8 is a diagram illustrating a normalized low band spectrum according to Embodiment 1 of the present invention.

Furthermore, in FIG. 6, it is assumed that the core coding section has encoded spectrum parts at positions p0 to p10 by means of transform coding. In FIGS. 6, 7 and 8, the encoded spectrum parts are illustrated in terms of spectrum power. As illustrated in FIG. 6, it is difficult to calculate a correct envelope (dashed line in FIG. 6) from a discrete spectrum (core-coding low band spectrum: spectrum parts at positions p0 to p10). For example, in FIG. 6, the estimated envelope indicated by the curved solid line (envelope obtained from the core-coding low band spectrum) is different from the input signal envelope indicated by the curved dashed line.

FIG. 7 illustrates an example of a normalized low band spectrum calculated from an estimated envelope (incorrect envelope) in the related art, which is indicated as spectrum power. In FIG. 7, symbols that are the same as those in FIG. 6 represent the same in FIG. 6. If a low band spectrum is normalized using an incorrect envelope, as illustrated in FIG. 7, in the normalized low band spectrum, variations in spectrum amplitude in the respective sub-bands become large. For example, in FIG. 7, the spectrum amplitudes in sub-bands SB3 and SB5 are larger than the spectrum amplitudes in sub-bands SB0 and SB1. In particular, if an extremely-incorrect envelope is estimated in a band, the spectrum in the band has extremely large power compared to the spectrums in the other bands.

On the other hand, FIG. 8 illustrates a normalized low band spectrum obtained by sub-band amplitude normalizing section 103 in the present embodiment, which is indicated as spectrum power. In FIG. 8, symbols that are the same as those in FIG. 7 represent the same in FIG. 7.

In sub-band amplitude normalizing section 103, largest value searching section 132 makes a search to find a sub-band largest value in each of sub-bands SB0 to SB5. For example, as illustrated in FIG. 8, largest value searching section 132 identifies spectrum part (p1) having a largest amplitude value from among spectrum parts (p0 and p1) included in SB0 as a sub-band largest value for SB0. Likewise, as illustrated in FIG. 8, largest value searching section 132 identifies a spectrum part (p2) having a largest amplitude value from among spectrum parts (p2 and p3) included in SB1 as a sub-band largest value for SB1. Largest value searching section 132 also identifies spectrum parts (p5, p7, p8 and p10) each having a largest amplitude value as sub-band largest values for respective sub-bands SB2 to SB5 illustrated in FIG. 8.

Next, amplitude normalizing section 133 normalizes the spectrum included in each sub-band (sub-band divisional core-coding low band spectrum) using the sub-band largest value for the sub-band. For example, amplitude normalizing section 133 normalizes spectrum parts p0 and p1 in SB0 illustrated in FIG. 8 using the relevant sub-band largest value (amplitude value of spectrum part p1). Likewise, amplitude normalizing section 133 normalizes spectrum parts p2 and p3 in SB1 illustrated in FIG. 8 using the relevant sub-band largest value (amplitude value of spectrum part p2). The same applies to SB2 to SB5.

As a result, a spectrum having a largest amplitude in each sub-band certainly has a value of 1.0. In FIG. 8, also, spectrum parts each having the largest amplitude have spectrum power of 1.0. However, here, no effects of minimal values as countermeasures for division by zero are taken into account. In other words, in all of sub-bands SB0 to SB5 illustrated in FIG. 8, the respective largest amplitude values after normalization are uniformed to be the same value (1.0).

Consequently, the characteristics of the spectrum can be made flat through the sub-bands, and thus, no spectrum part having an extremely-large amplitude can be generated. In other words, sub-band amplitude normalizing section 103 can obtain a normalized low band spectrum that is highly correlated with an extension band spectrum (in general, a spectrum whose frequency characteristics are flat compared to those of a low band spectrum). In other words, sub-band amplitude normalizing section 103 can transform a core-coding low band spectrum generated as a result of an input signal spectrum being encoded and decoded by core coding section 102 into a normalized low band spectrum whose characteristics are flat. Consequently, coding apparatus 100 can obtain a normalized low band spectrum that is highly correlated with an extension band spectrum, enabling enhancement in sound quality in the high band.

The details of the configuration and operation of sub-band amplitude normalizing section 103 have been described above.

As described above, according to the present embodiment, in sub-band amplitude normalizing section 103 of coding apparatus 100, largest value searching section 132 makes a search to find a largest amplitude value in each of the plurality of sub-bands of a core-coding low band spectrum, the sub-bands being obtained by dividing a low band part of an input signal, the low band part being not higher than a predetermined frequency (sub-band largest value), and amplitude normalizing section 133 normalizes the core-coding low band spectrum in each sub-band using the sub-band largest value of the sub-band. Then, coding apparatus 100 encodes an extension band spectrum using the normalized core-coding low band spectrum (normalized low band spectrum).

Consequently, even if a core-coding low band spectrum obtained as a result of encoding by core coding section 102 is a discrete spectrum, coding apparatus 100 prevents generation of a spectrum part having an extremely-large amplitude, enabling provision of a normalized low band spectrum whose characteristics are flat. Consequently, in the normalized low band spectrum, no spectrum part having an extremely-large amplitude exists, and thus, coding apparatus 100 copies a spectrum in a low band part having a sufficiently-lowered peaking property to a high band part (extension band), whereby generation of a spectrum having an excessively-high peaking property in the extension band (high band part) can be prevented, which in turn, enables generation of a high-quality extension band spectrum.

Embodiment 2

As described above, when encoding a spectrum in an extension band (high band part) of an input signal, a coding apparatus uses a spectrum resulting from a normalized low band spectrum being copied to the extension band as a spectrum fine structure. This can be regarded as utilizing a harmonic structure in a spectrum in a low band part of an input signal. In other words, provision of a clearer decoded signal can be expected by emphasizing the harmonic structure in the spectrum in the low band part of the input signal.

Therefore, in the present embodiment, a case where a harmonic structure in a normalized low band spectrum obtained in Embodiment 1 is emphasized further will be described.

Figure 9:
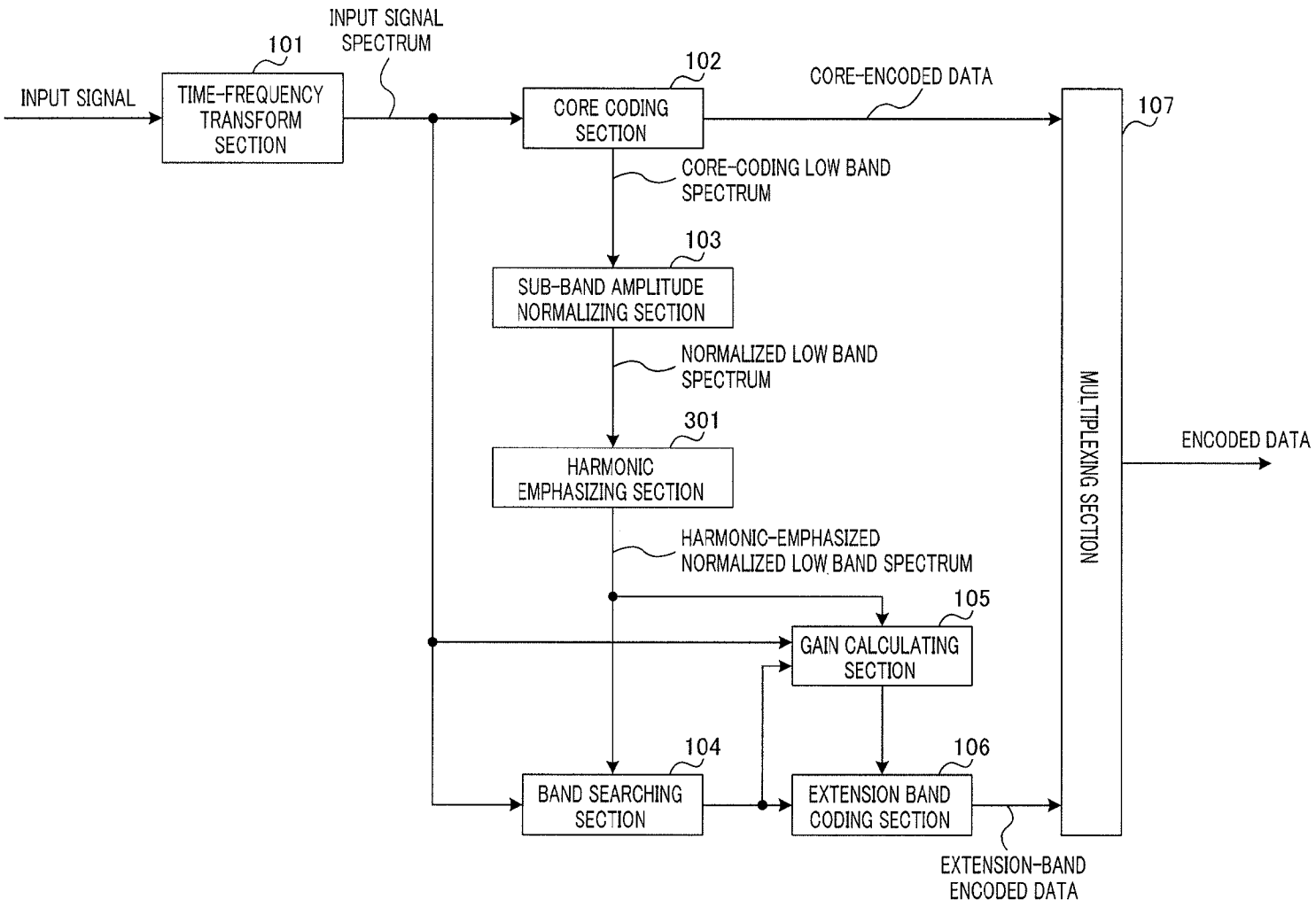
FIG. 9 is a block diagram illustrating a configuration of a coding apparatus according to Embodiment 2 of the present invention.

FIG. 9 is a block diagram illustrating a configuration of coding apparatus 300 according to the present embodiment. In coding apparatus 300 illustrated in FIG. 9, components other than harmonic emphasizing section 301 are the same as those of coding apparatus 100 (FIG. 1) according to Embodiment 1 and thus are provided with reference numerals that are the same as those of coding apparatus 100, and a description thereof will be omitted herein.

Harmonic emphasizing section 301 emphasizes a harmonic structure in a normalized low band spectrum received as input from sub-band amplitude normalizing section 103 and outputs the normalized low band spectrum with the harmonic structure emphasized (harmonic-emphasized normalized low band spectrum) to band searching section 104 and gain calculating section 105.

In other words, band searching section 104 makes a search to find a particular band (a band having a largest correlation value) using the harmonic-emphasized normalized low band spectrum and an input extension band spectrum. Also, gain calculating section 105 calculates a gain between a spectrum obtained as a result of the harmonic-emphasized normalized low band spectrum in the particular band being copied to the extension band (spectrum fine structure) and the input extension band spectrum.

Figure 10:
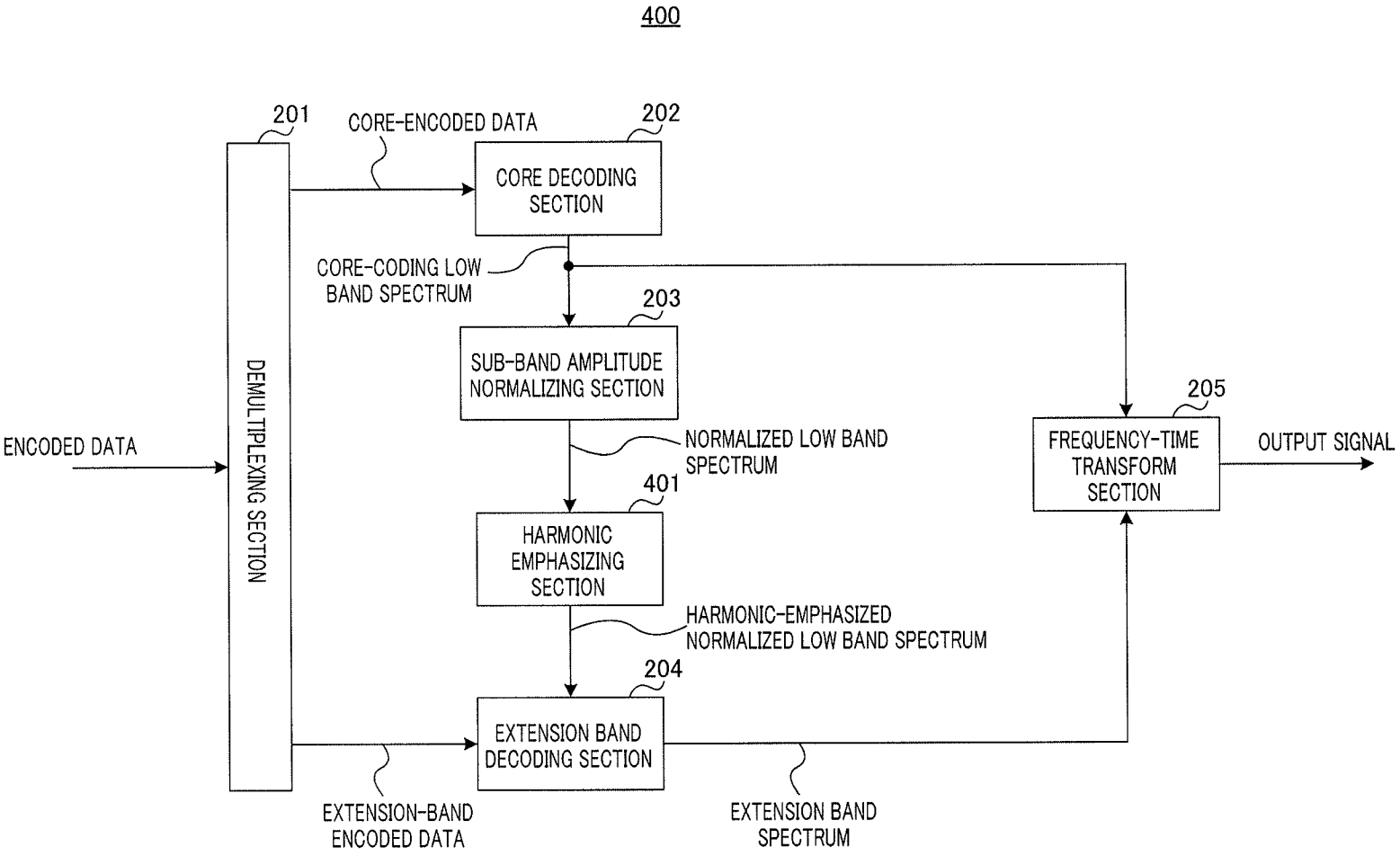
FIG. 10 is a block diagram illustrating a configuration of a decoding apparatus according to Embodiment 2 of the present invention.

FIG. 10 is a block diagram illustrating a configuration of decoding apparatus 400 according to the present embodiment. In decoding apparatus 400 illustrated in FIG. 10, components other than harmonic emphasizing section 401 are the same as those of decoding apparatus 200 (FIG. 3) according to Embodiment 1, and thus, are provided with reference numerals that are the same as those of decoding apparatus 200 and a description thereof will be omitted here. Also, the configuration and operation of harmonic emphasizing section 401 are the same as those of harmonic emphasizing section 301 illustrated in FIG. 9, and thus, a detailed description thereof will be omitted.

Next, details of the harmonic structure emphasis processing in harmonic emphasizing section 301 will be described.

As described above, core coding section 102 encodes a low band spectrum only in a small number of pulses when the bit rate is low. In this case, spectrum parts having large energy can preferentially be encoded. Also, spectrum parts having large energy can be highly likely to be important spectrum parts forming a harmonic structure. Furthermore, spectrum parts (spectrum parts having high energy) forming a harmonic structure are supposed to be discretely distributed.

Based on the above, harmonic emphasizing section 301 leaves a spectrum part having a large amplitude in each sub-band of a normalized low band spectrum (spectrum part corresponding to a sub-band largest value in each sub-band) and removes spectrum parts other than the spectrum part corresponding to the sub-band largest value in each sub-band. In a harmonic-emphasized normalized low band spectrum resulting from this, many spectrum parts forming the harmonic structure remain, enabling emphasis of the harmonic structure.

Figure 11A:
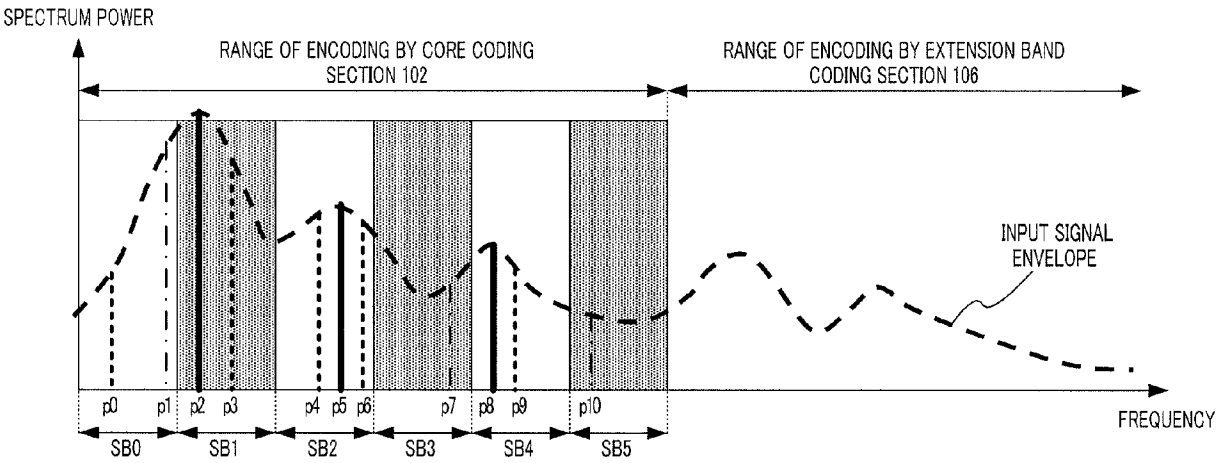
FIGS. 11A and 11B are diagrams illustrating envelope calculation processing and a harmonic-emphasized normalized low band spectrum according to Embodiment 2 of the present invention.
Figure 11B:
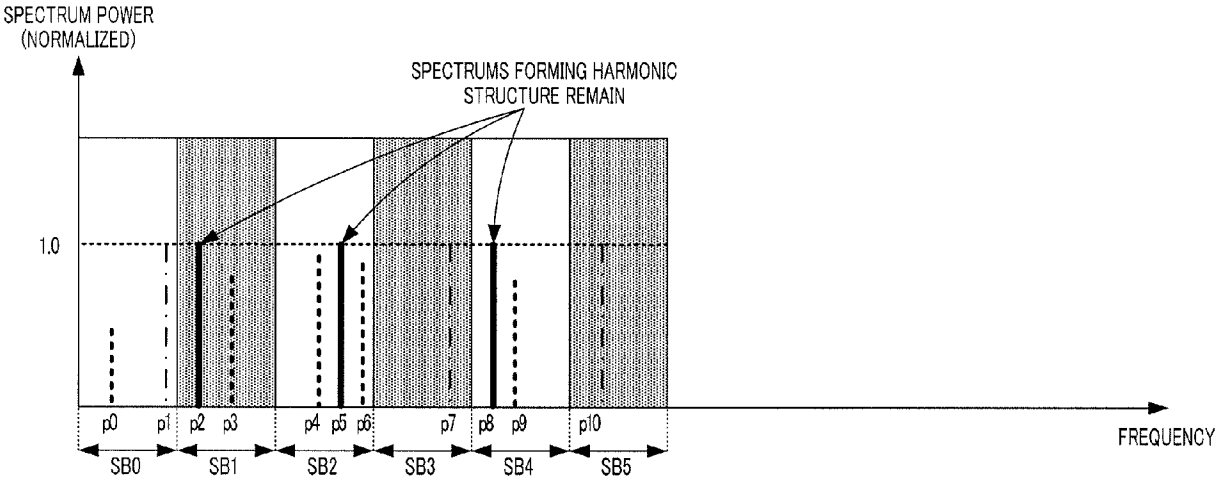

FIGS. 11A and 11B illustrate harmonic emphasis processing in harmonic emphasizing section 301. FIG. 11A indicates the envelope of the input signal spectrum (input signal envelope) illustrated in FIG. 6 and spectrum power of a low band spectrum (core-coding low band spectrum) encoded by core coding section 102. FIG. 11B indicates a harmonic-emphasized normalized low band spectrum obtained in the present embodiment as spectrum power. In FIGS. 11A and 11B, symbols that are the same as those in FIG. 6, 7 or 8 represent the same in FIG. 6, 7 or 8.

Also, here, for simplicity, a case where only one pulse is left per sub-band will be described as an example.

Pulses (p2, p5 and p8) indicated by the solid lines in FIGS. 11A and 11B each indicate spectrum power of an encoded spectrum part in the vicinity of a peak of the input signal envelope, and are spectrum parts having a largest amplitude (absolute value) in respective sub-bands (SB1, SB2 and SB4) (spectrum parts corresponding to a sub-band largest value). Pulses (p0, p3, p4, p6 and p9) indicated by the dotted lines in FIGS. 11A and 11B each indicate spectrum power whose amplitude value is not largest in the respective sub-band. Pulses (p1, p7 and p10) indicated by the alternate long and short dash lines in FIGS. 11A and 11B indicate spectrum parts that are not in the vicinity of a peak of the envelope but each have a largest amplitude (absolute value) in the respective sub-bands.

Harmonic emphasizing section 301 leaves spectrum parts each having a sub-band largest value in a normalized low band spectrum and removes spectrum parts other than the spectrum parts each having a sub-band largest value. In other words, in FIGS. 11A and 11B, harmonic emphasizing section 301 leaves spectrum parts (pulses) p1, p2, p5, p7, p8 and p10 and removes spectrum parts (pulses) p0, p3, p4, p6 and p9.

Consequently, as illustrated in FIG. 11A, all of encoded spectrum parts (solid-line spectrum parts) in the vicinity of peaks of the input signal envelope are left and the spectrum parts other than such spectrum parts are removed, which in turn, enables harmonic structure enhancement.

The above-described configuration and operation of coding apparatus 300 enables a harmonic structure to be expressed in an extension band spectrum. In other words, coding apparatus 300 enables a harmonic structure to be emphasized even in an extension band of an input signal, and thus enables generation of a clearer and higher-quality extension band spectrum compared to Embodiment 1. Consequently, coding apparatus 300 can generate an extension band spectrum of clear and high quality sound.

Also, according to the present embodiment, as in Embodiment 1, even if a low band spectrum obtained by encoding by core coding section 102 is a discrete spectrum, coding apparatus 300 prevents generation of a spectrum part having an extremely-large amplitude, enabling a normalized low band spectrum whose characteristics are flat. Consequently, as in Embodiment 1, generation of a spectrum having an excessively-high peaking property is prevented in the extension band (high band part), enabling generation of a high-quality extension band spectrum.

In the present embodiment, a case where harmonic emphasizing section 301 leaves only a spectrum part having a largest amplitude value in each sub-band (sub-band largest value) has been described. However, it is possible that harmonic emphasizing section 301 sets a predetermined ratio (for example, 0.75) of an amplitude relative to a sub-band largest value as a threshold (hereinafter referred to as "minimal spectrum part removal threshold") in each sub-band, leave a spectrum part having an amplitude equal to or larger than the minimal spectrum part removal threshold and suppresses or removes spectrum parts each having an amplitude smaller than the minimal spectrum part removal threshold (that is, spectrum parts other than the spectrum part having an amplitude equal to or larger than the minimal spectrum part removal threshold). Also, harmonic emphasizing section 301 may even suppresses or remove a spectrum part having a sub-band largest value if the amplitude of the spectrum part before normalization is small.

Embodiment 3

In Embodiment 3, the degree of emphasis of a harmonic structure in the harmonic emphasis processing in Embodiment 2 is adaptively controlled.

Figure 12:
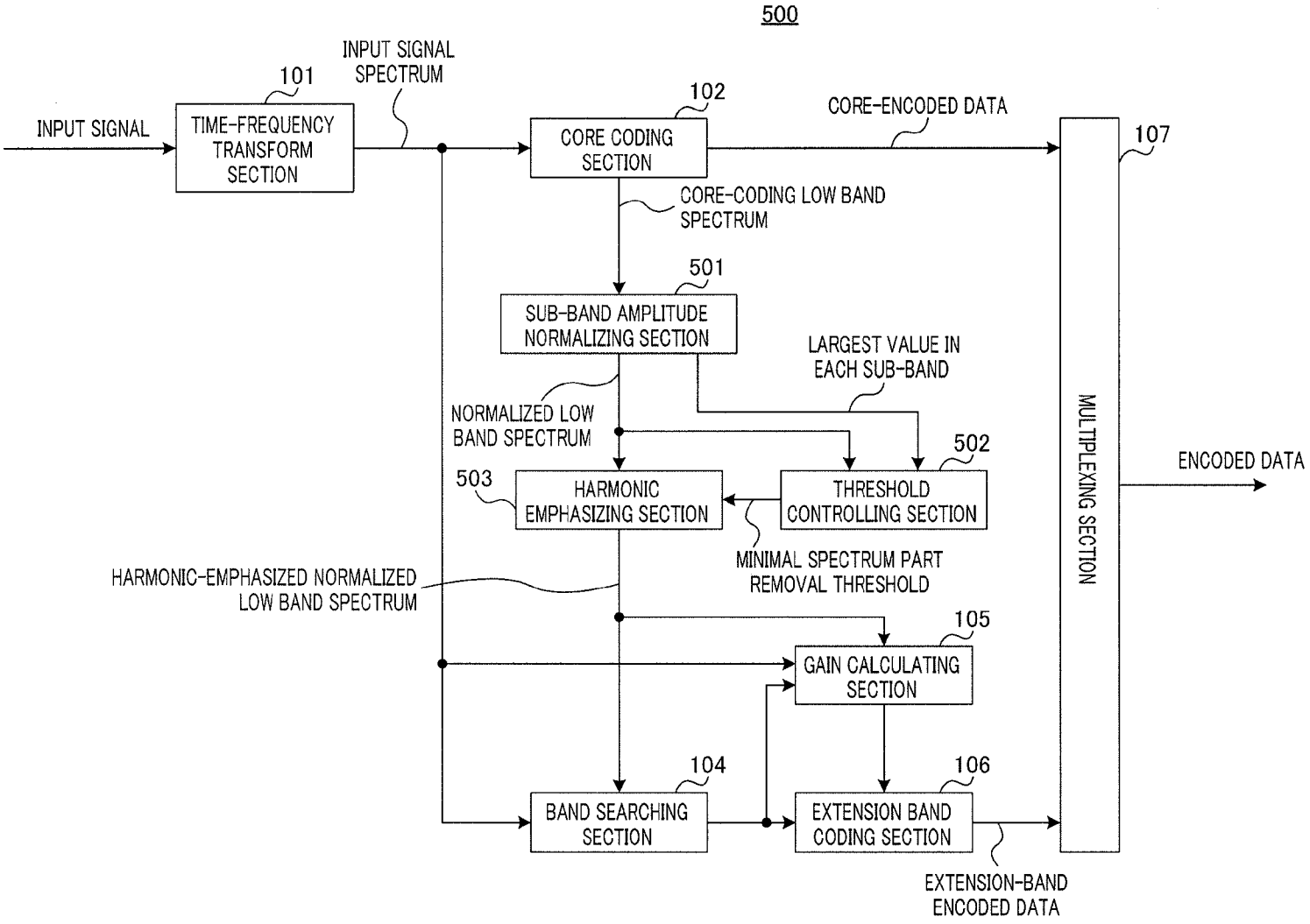
FIG. 12 is a block diagram illustrating a configuration of a coding apparatus according to Embodiment 3 of the present invention.

FIG. 12 is a block diagram illustrating a configuration of coding apparatus 500 according to the present embodiment. In coding apparatus 500 illustrated in FIG. 12, components other than sub-band amplitude normalizing section 501, threshold controlling section 502 and harmonic emphasizing section 503 are the same as those of coding apparatus 300 (FIG. 9) according to Embodiment 2, and thus are provided with reference numerals that are the same as those of coding apparatus 300, and a description thereof will be omitted here.

Sub-band amplitude normalizing section 501 outputs a normalized low band spectrum to threshold controlling section 502 and harmonic emphasizing section 503, and outputs a sub-band largest value in each sub-band, which corresponds to the output of largest value searching section 132 (FIG. 5), to threshold controlling section 502.

Threshold controlling section 502 controls a minimal spectrum part removal threshold using a normalized low band spectrum and a sub-band largest value received as input from sub-band amplitude normalizing section 501. Here, the minimal spectrum part removal threshold is a threshold for determining whether or not a normalized low band spectrum part (pulse) is removed (or suppressed) in harmonic emphasis processing in harmonic emphasizing section 503. For example, threshold controlling section 502 calculates a minimal spectrum part removal threshold based on the degree of importance of each sub-band in the low band spectrum. Threshold controlling section 502 outputs the minimal spectrum part removal thresholds to harmonic emphasizing section 503.

Harmonic emphasizing section 503 performs harmonic emphasis processing on a normalized low band spectrum received as input from sub-band amplitude normalizing section 501, using the minimal spectrum part removal thresholds received as input from threshold controlling section 502. More specifically, harmonic emphasizing section 503 compares each component in each sub-band of the normalized low band spectrum and the minimal spectrum part removal threshold set for the sub-band. For example, harmonic emphasizing section 503 leaves spectrum parts (pulses) having an amplitude equal to or larger than the minimal spectrum part removal threshold and removes (or suppresses) spectrum parts (pulses) having an amplitude smaller than the minimal spectrum part removal threshold.

Figure 13:
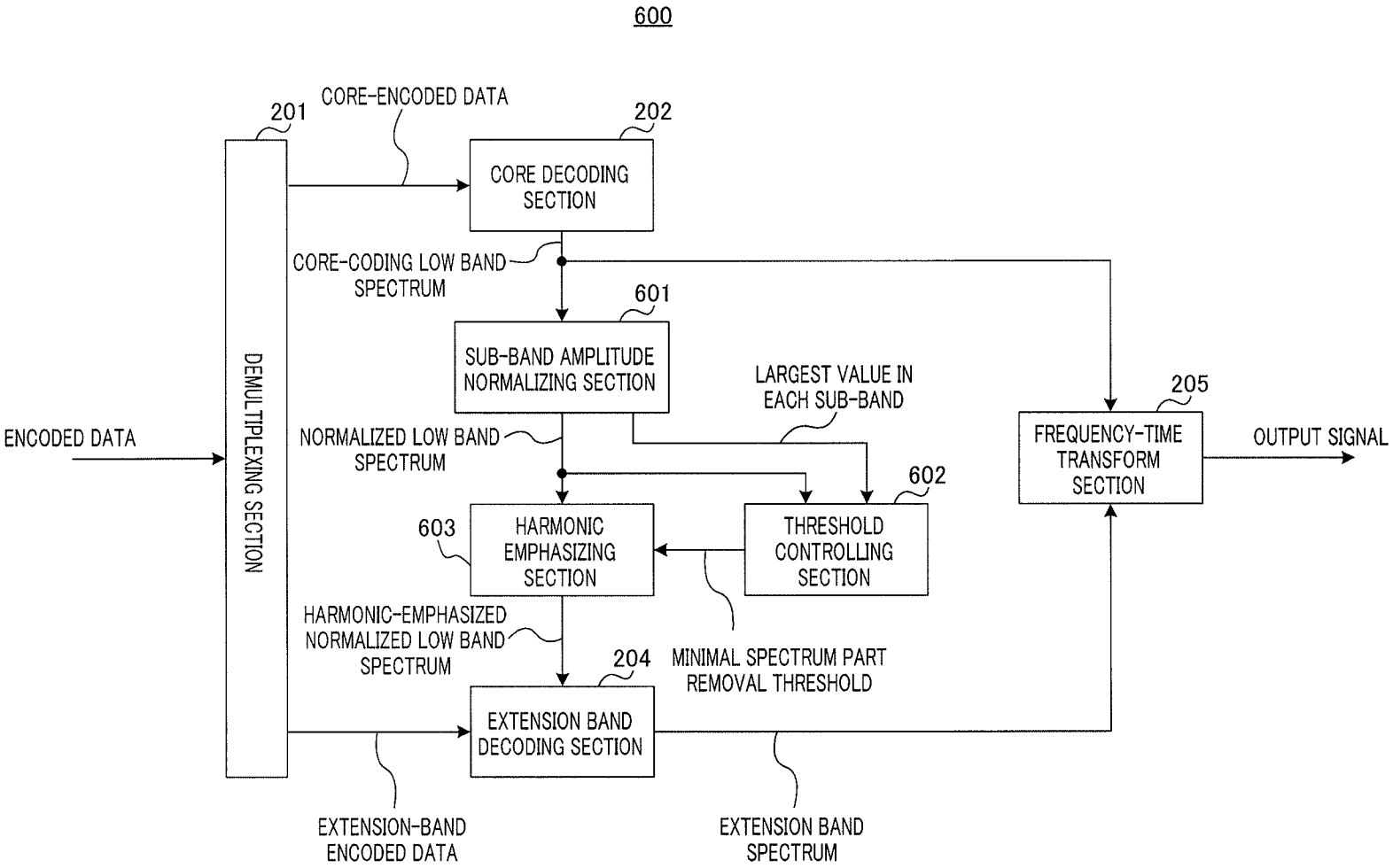
FIG. 13 is a block diagram illustrating a configuration of a decoding apparatus according to Embodiment 3 of the present invention.

FIG. 13 is a block diagram illustrating an internal configuration of decoding apparatus 600 according to the present embodiment. In decoding apparatus 600 illustrated in FIG. 13, components other than sub-band amplitude normalizing section 601, threshold controlling section 602 and harmonic emphasizing section 603 are the same as those of decoding apparatus 400 (FIG. 10) according to Embodiment 2 and thus are provided with reference numerals that are the same as those of decoding apparatus 400, and a description thereof will be omitted here. The configuration and operation of sub-band amplitude normalizing section 601, threshold controlling section 602 and harmonic emphasizing section 603 are the same as those of sub-band amplitude normalizing section 501, threshold controlling section 502 and harmonic emphasizing section 503 illustrated in FIG. 12, and thus, a detailed description thereof will be omitted.

Next, details of minimal spectrum part removal threshold setting processing in threshold controlling section 502 and harmonic emphasis processing in harmonic emphasizing section 503 will be described.

In a spectrum in a low band part of an input signal, a sub-band is aurally more important as the largest value (sub-band largest value) in amplitude of the spectrum in the sub-band is larger. Thus, in such sub-band, it is preferable to leave not only a spectrum part corresponding to a sub-band largest value but also spectrum parts which are located around the spectrum part corresponding to the sub-band largest value and each of which has a large amplitude.

On the other hand, it is less likely that spectrum parts in a sub-band of a low band spectrum that has a small sub-band largest value are included in a harmonic structure. Thus, in such sub-band, it is preferable to leave a smallest possible number of spectrum parts only.

An example of setting of minimal spectrum part removal threshold in threshold controlling section 502 will be described taking into account the above described factors.

First, threshold controlling section 502 makes a search to find a largest value from among sub-band largest values in the respective sub-bands and determines the found largest value as an overall sub-band largest value.

Next, threshold controlling section 502 determines a sub-band having a sub-band largest value that is, for example, 0.5 times or more the overall sub-band largest value as a sub-band that is aurally important, and sets the minimal spectrum part removal threshold to be low. For example, threshold controlling section 502 sets the minimal spectrum part removal threshold for such sub-band to 0.25.

On the other hand, threshold controlling section 502 determines a sub-band having a sub-band largest value that is, for example, smaller than 0.5 times the overall sub-band largest value as a sub-band that is not aurally important, and sets the minimal spectrum part removal threshold to be large. For example, threshold controlling section 502 sets the minimal spectrum part removal threshold for such sub-band to 0.95.

In other words, threshold controlling section 502 sets a small minimal spectrum part removal threshold (threshold for harmonic emphasizing section 503 to determine whether or not to leave or remove a normalized low band spectrum part) for a sub-band from among a plurality of sub-bands in a low band part of an input signal if a ratio of the sub-band largest value relative to the overall sub-band largest value (largest value in the sub-band largest values in the respective sub-bands) in the sub-band is equal to or larger than a predetermined value (here, 0.5) and sets a large minimal spectrum part removal threshold for a sub-band from the plurality of sub-bands if the ratio of the sub-band largest value relative to the overall sub-band largest value in the sub-band is smaller than the predetermined value (here 0.5).

Consequently, harmonic emphasizing section 503, for example, here, leaves spectrum parts having an amplitude that is 0.25 times or more the relevant sub-band largest value in an aurally-important sub-band and removes spectrum parts having an amplitude that is smaller than 0.25 times the sub-band largest value. In other words, it is highly likely that more spectrum parts are left in aurally-important sub-bands.

On the other hand, harmonic emphasizing section 503, for example, here, leaves spectrum parts having an amplitude that is 0.95 times or more the relevant sub-band largest value in a sub-band that is not aurally important and removes spectrum parts having an amplitude that is smaller than 0.95 times the sub-band largest value. In other words, it is highly likely that only an extremely-small number of spectrum parts are left in a sub-band that is not aurally important.

The above-described configuration and operation of coding apparatus 500 makes a large number of spectrum parts be left in a sub-band that is aurally important and a small number of spectrum parts be left in a sub-band that is not aurally important in a normalized low band spectrum. Consequently, a clear decoded signal resulting from harmonic emphasis can be provided. Furthermore, a large number of spectrum fine structures in aurally-important bands are left, which in turn, enables provision of a more natural decoded signal.

Where the sub-band largest value is an extremely small value and it is determined that a sub-band corresponding to the sub-band largest value is a sub-band that is aurally not indispensable, threshold controlling section 502 may set a minimal spectrum part removal threshold that is larger than 1.0. Consequently, harmonic emphasizing section 503 removes all of spectrum parts (largest value: 1.0) in such sub-band, enabling further emphasis of the harmonic structure.

As described above, according to the present embodiment, when emphasizing a harmonic structure in a normalized low band spectrum, coding apparatus 500 adaptively controls the degree of harmonic emphasis in each sub-band using a sub-band largest value (or sub-band energy) in the sub-band. More specifically, coding apparatus 500 performs control so that a larger number of fine structures in the spectrum are left in sub-bands having a larger sub-band largest value (i.e., aurally-important sub-bands) and only spectrum parts relating to the sub-band largest value (that is, spectrum parts relating to a harmonic structure) are left in sub-bands having a smaller sub-band largest value (sub-bands that are not aurally important).

Consequently, as in Embodiment 2, coding apparatus 500 enables emphasis of a harmonic structure also in an extension band, enabling generation of a clear and high-quality extension band spectrum. Furthermore, according to the present embodiment, spectrum fine structures in aurally-important sub-bands are left more precisely, enabling provision of a more natural decoded signal.

Furthermore, according to the present embodiment, as in Embodiment 1, even if a low band spectrum obtained by encoding in core coding section 102 is a discrete spectrum, coding apparatus 500 limits generation of a spectrum part having an extremely-large amplitude, enabling provision of a normalized low band spectrum whose characteristics are flat. Consequently, as in Embodiment 1, generation of a spectrum having an excessively-high peaking property in an extension band (high band part) is prevented, which in turn, enables generation of a high-quality extension band spectrum.

Embodiment 4

An input signal does not always have only a small energy bias in an extension band spectrum. For example, like a sound of a metallophone, a signal having a large energy bias in an extension band spectrum exists. In the case of such input signal, the sound quality can be enhanced by performing normalization using a spectrum power envelope to generate a normalized extension band spectrum according to the related art, rather than generating a normalized low band spectrum in sub-band amplitude normalizing section 103. In addition, if a general music signal like in an orchestra and a signal of a sound having a large energy bias like a metallophone are mixed in one input sample, use of a method for determining and selecting a low band spectrum normalization method for each frame enables stable sound quality enhancement.

In Embodiment 4, a description will be given of a configuration in which a normalized extension band spectrum is generated by determining a characteristic of an input signal for each frame and switching between a method for performing normalization using a largest value in a spectrum included in each sub-band and a method for performing normalization using a spectrum power envelope based on a result of the determination.

Figure 14:
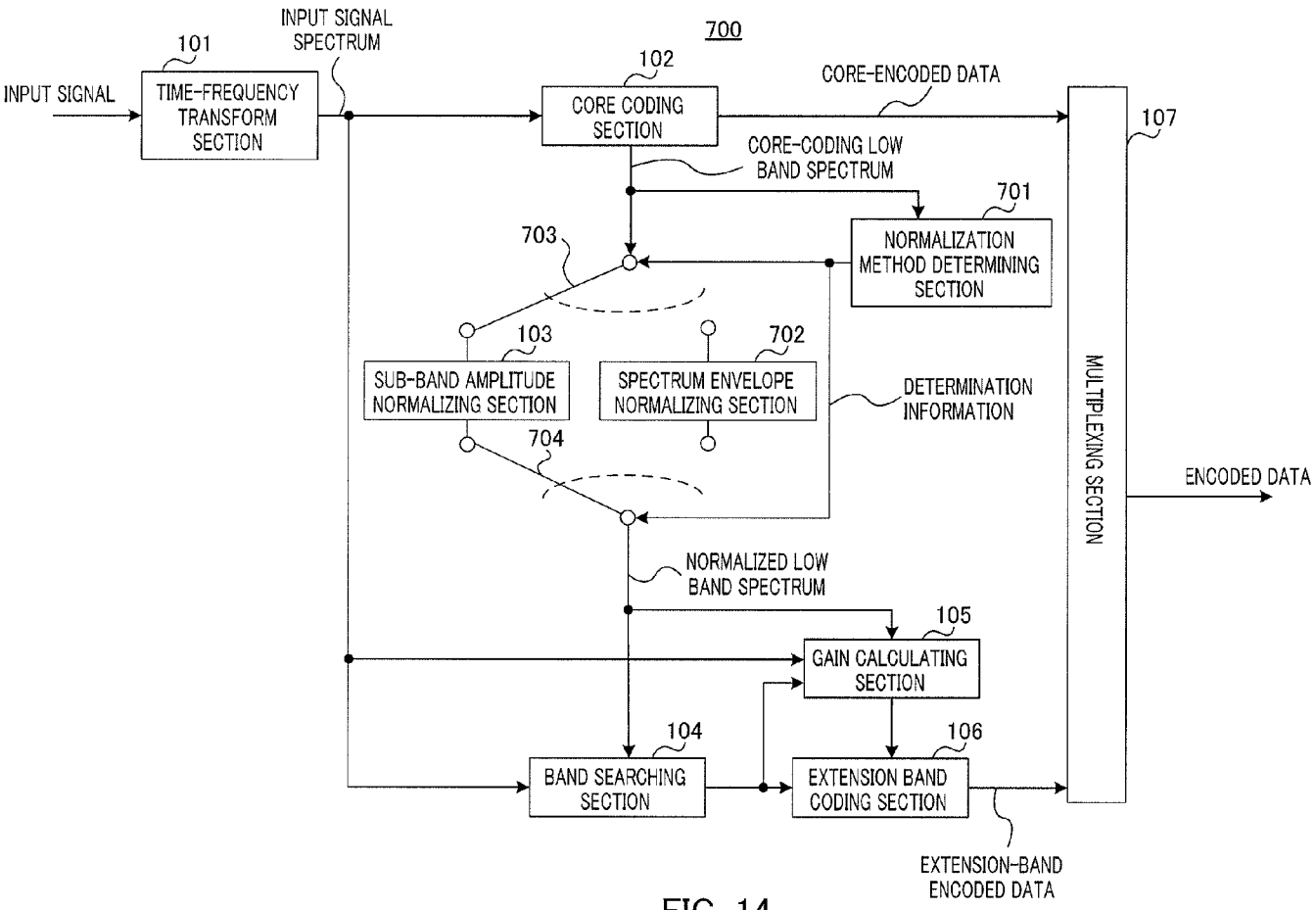
FIG. 14 is a block diagram illustrating a configuration of a coding apparatus according to Embodiment 4 of the present invention.

FIG. 14 is a block diagram illustrating a configuration of coding apparatus 700 according to the present embodiment. In coding apparatus 700 illustrated in FIG. 14, components other than normalization method determining section 701, spectrum envelope normalizing section 702 and switches 703 and 704 are the same as those of coding apparatus 100 (FIG. 1) according to Embodiment 1 and thus are provided with reference numerals that are the same as those of coding apparatus 100, and a description thereof will be omitted here.

Normalization method determining section 701 analyzes a core-coding low band spectrum to determine whether sub-band amplitude normalizing section 103 or spectrum envelope normalizing section 702 is used for normalization of the core-coding low band spectrum, and outputs determination information indicating a result of the determination to switches 703 and 704. Here, it is assumed that if the determination information indicates "0," sub-band amplitude normalizing section 103 is selected, and the determination information indicates "1," spectrum envelope normalizing section 702 is selected.

Normalization method determining section 701 analyzes an intensity of the peaking property of an input core-coding low band spectrum and selects sub-band amplitude normalizing section 103 if the peaking property is smaller than a predetermined threshold, and selects spectrum envelope normalizing section 702 if the peaking property is larger than the predetermined threshold. The magnitude of the peaking property is determined by comparison between a parameter such as, for example, a sub-band energy dispersion value, a spectrum flatness measure expressed by a ratio of an arithmetic average to a geometric average of the spectrum or the number of spectrum parts having a value exceeding a threshold prescribed by an average value and a standard deviation of spectrum part amplitudes, and a threshold.

Spectrum envelope normalizing section 702 normalizes the core-coding low band spectrum input from core coding section 102 to generate a normalized low band spectrum. Details of a configuration and operation of spectrum envelope normalizing section 702 will be described later.

Switch 703 connects core coding section 102 and sub-band amplitude normalizing section 103 if the determination information indicates "0," and connects core coding section 102 and spectrum envelope normalizing section 702 if the determination information indicates "1." Switch 704 connects sub-band amplitude normalizing section 103 and band searching section 104 if the determination information indicates "0," and connects spectrum envelope normalizing section 702 and band searching section 104 if the determination information indicates "1."

Figure 15:
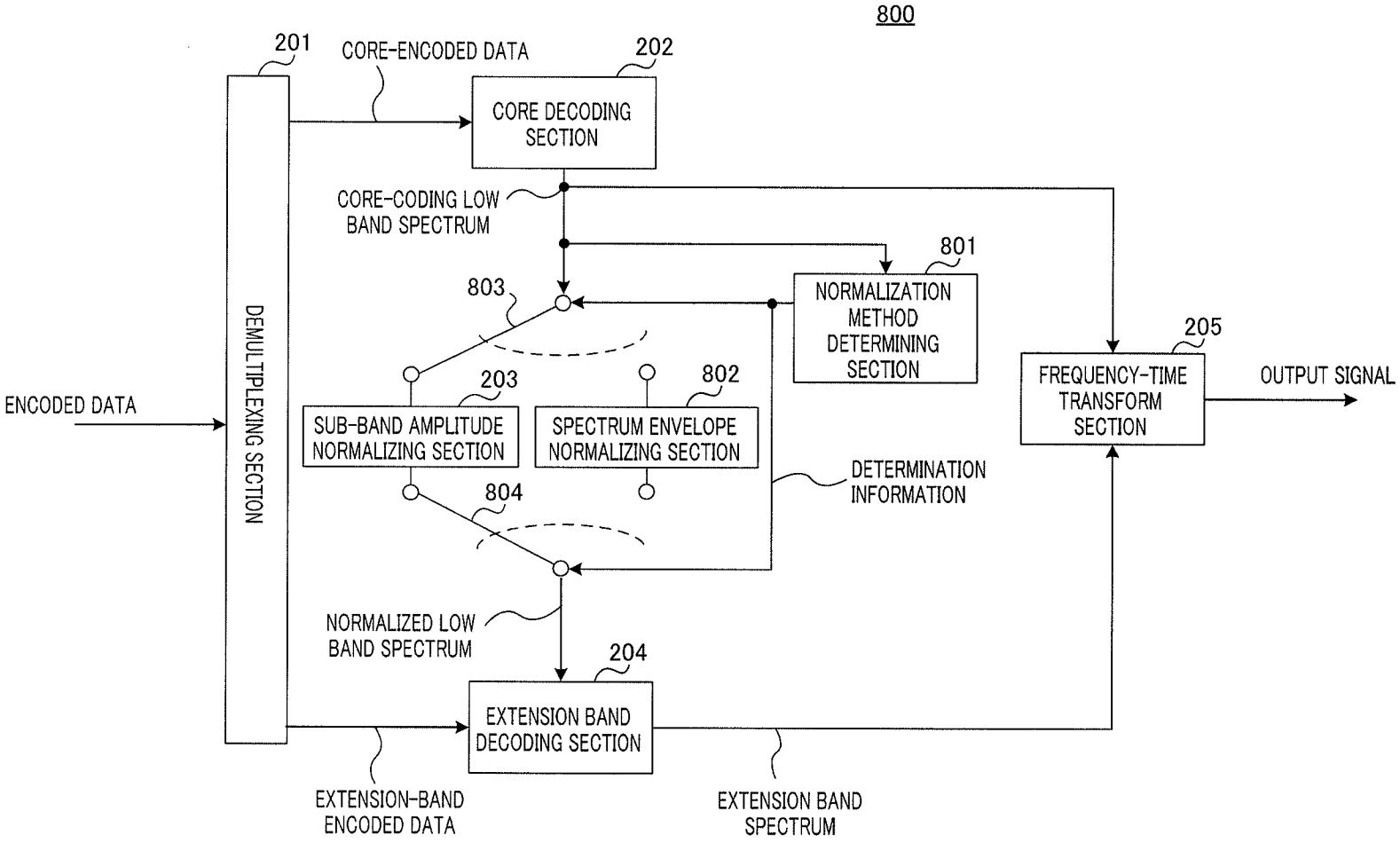
FIG. 15 is a block diagram illustrating a configuration of a decoding apparatus according to Embodiment 4 of the present invention.

FIG. 15 is a block diagram illustrating a configuration of decoding apparatus 800 according to the present embodiment. In decoding apparatus 800 illustrated in FIG. 15, components other than normalization method determining section 801, spectrum envelope normalizing section 802 and switches 803 and 804 are the same as those of decoding apparatus 200 (FIG. 3) according to Embodiment 1 and thus are provided with reference numerals that are the same as those of decoding apparatus 200, and a description thereof will be omitted here.

The configuration and operation of normalization method determining section 801 are the same as those of normalization method determining section 701 illustrated in FIG. 14, and a detailed description thereof will be omitted. Normalization method determining section 801 uses a method that is the same as a method selected in normalization method determining section 701 to obtain determination information that is the same as that obtained in normalization method determining section 701.

Spectrum envelope normalizing section 802 normalizes a core-coding low band spectrum input from core decoding section 202 to generate a normalized low band spectrum. A configuration and operation of spectrum envelope normalizing section 802 are the same as those of spectrum envelope normalizing section 702 illustrated in FIG. 14 (which will be described later) and thus, a detailed description thereof will be omitted. Furthermore, operation of switches 803 and 804 is the same as that of switches 703 and 704 illustrated in FIG. 14 and thus, a detailed description thereof will be omitted.

Switch 803 connects core decoding section 202 and sub-band amplitude normalizing section 203 if the determination information indicates "0," and connects core decoding section 202 and spectrum envelope normalizing section 802 if the determination information indicates "1." Switch 804 connects sub-band amplitude normalizing section 203 and extension band decoding section 204 if the determination information indicates "0," and connects spectrum envelope normalizing section 802 and extension band decoding section 204 if the determination information indicates "1."

Figure 16:
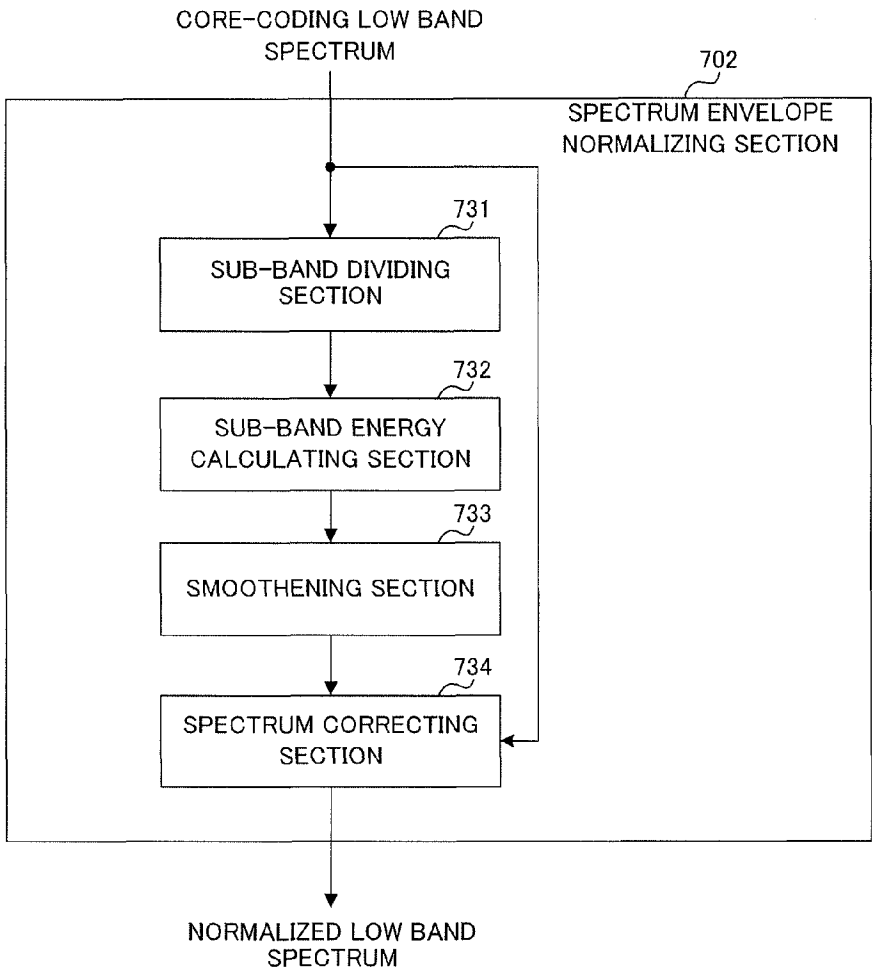
FIG. 16 is a block diagram illustrating an internal configuration of a spectrum envelope normalizing section in the coding apparatus according to Embodiment 4 of the present invention.

Next, a configuration and operation of spectrum envelope normalizing section 702 will be described in detail with reference to FIG. 16. Spectrum envelope normalizing section 702 illustrated in FIG. 16 includes sub-band dividing section 731, sub-band energy calculating section 732, smoothening section 733 and spectrum correcting section 734.

Sub-band dividing section 731 divides a core-coding low band spectrum into a plurality of sub-bands and outputs the plurality of sub-bands to sub-band energy calculating section 732. Sub-band energy calculating section 732 calculates energy of the core-coding low band spectrum in each sub-band (sub-band energy) and outputs the calculated energy to smoothening section 733. In order to smooth variations of the energy to estimate a spectrum envelope, smoothening section 733 smoothens the sub-band energy on the frequency axis. The smoothening is performed by, e.g., weighted average processing using neighbor sub-band energy or processing for autoregression of sub-band energy from a low-frequency to a high frequency. Smoothening section 733 regards smoothened sub-band energy calculated as described above as an estimated value of the spectrum envelope and outputs the estimated value to spectrum correcting section 734. Spectrum correcting section 734 multiplies the core-coding low band spectrum by the reciprocal of the smoothened sub-band energy to remove spectrum envelope components from the core-coding low band spectrum to generate and output a normalized low band spectrum.

Although in the present embodiment, the configuration that eliminates the need to transmit determination information to decoding apparatus 800 by analyzing a core-coding low band spectrum to obtain determination information has been described, the present invention is not limited to this configuration and a configuration in which determination information is transmitted to decoding apparatus 800 may be employed. In this case, the determination information is determined based on information that cannot be generated by decoding apparatus 800. For example, a high band part in an input signal spectrum is analyzed and determination information is determined based on, e.g., bias energy or an intensity of a peaking property of a spectrum included in the high band part.

Also, the present invention may have a configuration resulting from incorporating the harmonic emphasizing section described in Embodiment 2 and the threshold controlling section described in Embodiment 3 into Embodiment 4.

Embodiment 5

In Embodiment 1, a description has been given of the method for generating a candidate spectrum to be used for correlation value calculation so that the candidate spectrum has a starting point at a position shifted by a predetermined sample value expressed by a lag candidate in band searching section 104.

Figure 17:
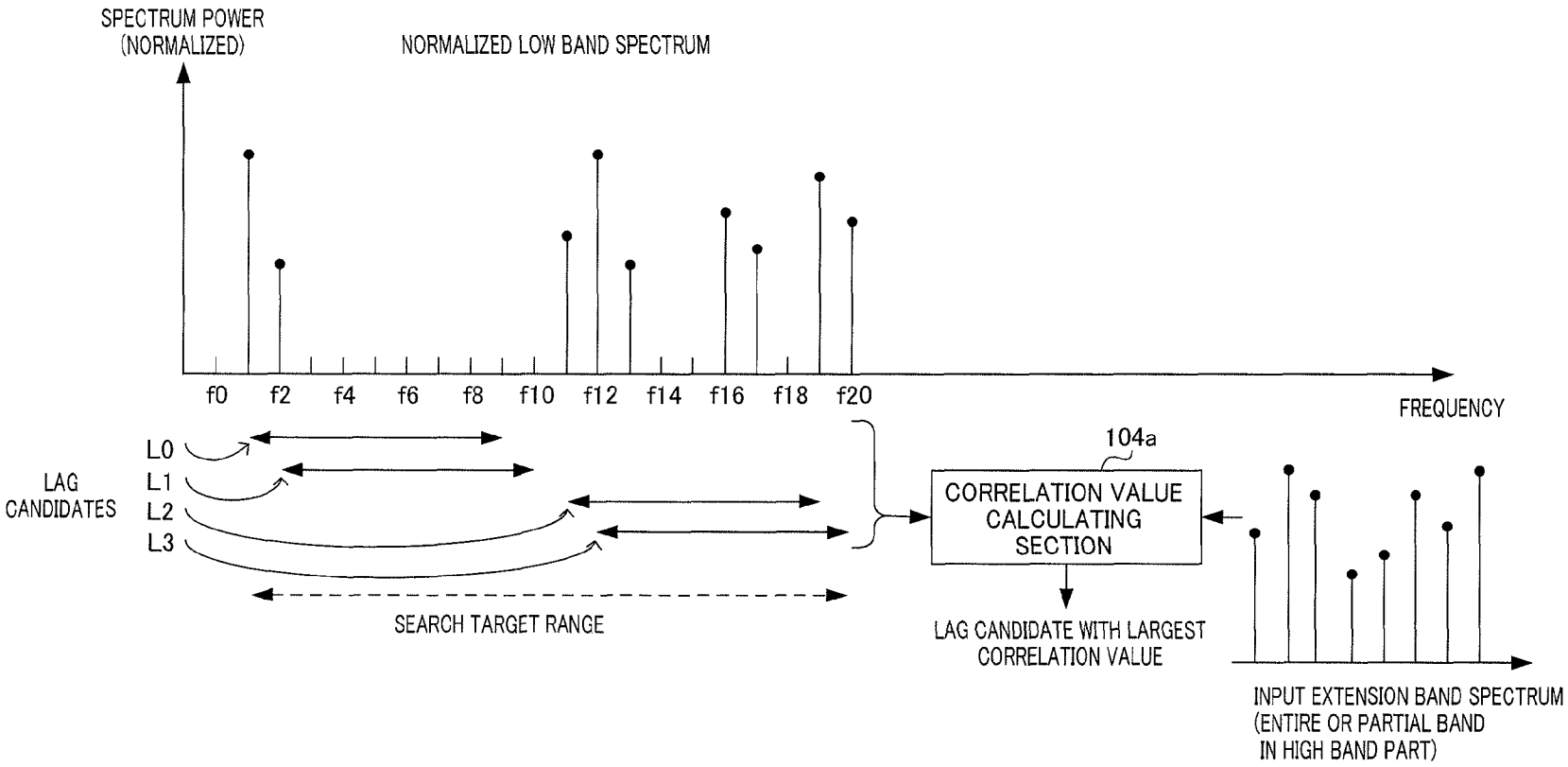
FIG. 17 is a diagram illustrating how a band searching section in a coding apparatus according to Embodiment 5 of the present invention operates.

In Embodiment 5, a description will be given of a method in which a lag candidate does not indicate the amount of shift by a given sample value but indicates what number normalized low band spectrum part included in a low band part. FIG. 17 is a diagram illustrating how band searching section 104 in the present embodiment operates.

As illustrated in FIG. 17, lag candidates (L0 to L3) each indicate the position of a normalized low band spectrum part whose amplitude value is not zero, as a starting point. In other words, as the lag candidate number is increased by one, positions of normalized low band spectrum parts whose amplitude values are zero are skipped and a position of a following normalized low band spectrum part is set as a starting point. A spectrum to be extracted is one included in a bandwidth that is the same as a bandwidth of an input extension band spectrum (entirety or part of an extension hand) from a frequency at the starting point. The extracted spectrum is output to correlation value calculating section **104*a*** as a candidate spectrum for correlation value calculation.

Consequently, even if the number of bits assigned to lag information is small, a wide search range can be set, at least one spectrum part certainly exists in a candidate spectrum. Accordingly, the problem of a candidate spectrum with spectrum parts whose amplitude values are all zero can be avoided. Also, at least one spectrum part exists in a low band part of a candidate spectrum, which matches a general characteristic of speech signals and music signals that signal energy is large in a low band relative to a high band, enabling sound quality enhancement.

Figure 18:
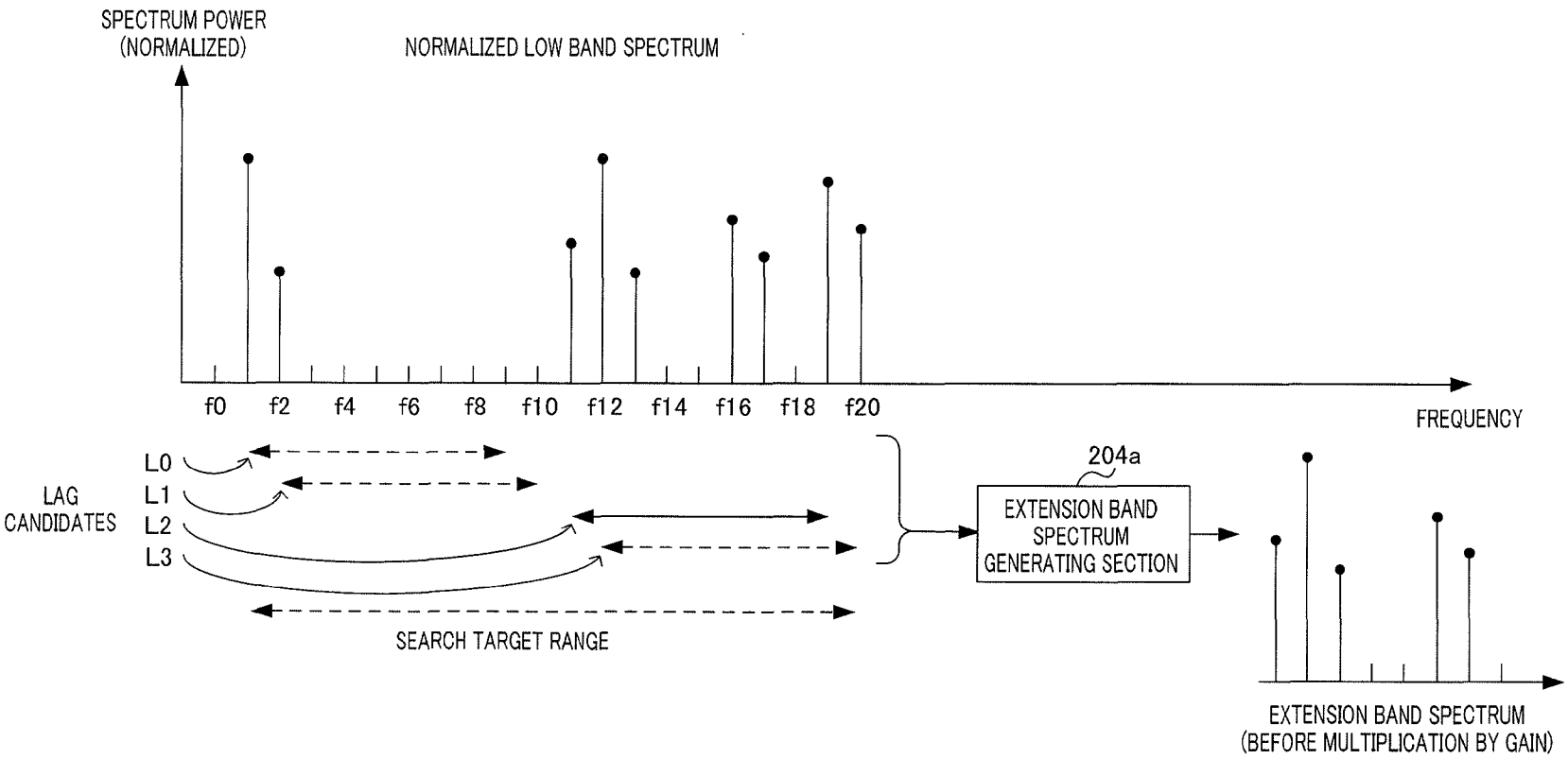
FIG. 18 is a diagram illustrating how an extension band decoding section in a decoding apparatus according to Embodiment 5 of the present invention operates.

FIG. 18 is a diagram illustrating how extension band decoding section 204 in the present embodiment operates. In the present embodiment, what number normalized low band spectrum part is to be used as a starting point is determined according to received lag information and a normalized low band spectrum included in a bandwidth of an extension band spectrum from the starting point is generated as an extension band spectrum (before multiplication by a gain). In the example in FIG. 18, lag information L2 has been obtained, and thus a frequency where normalized low band spectrum part f11 is positioned is used as a starting point.

Embodiment 6

In the above embodiment, an input signal is divided into frames of around 20 milliseconds and a spectrum of each frame is divided into a low band spectrum and an extension band spectrum, and encoding processing is performed using different coding methods for the low band spectrum and the extension band spectrum. In this case, the number of bits allocated to the extension band part is determined based on which coding method is to be used, and if a method using a constant bit rate is used, the bit count is constant. This means that even if energy of the extension band spectrum is very small, a fixed number of bits are constantly consumed, which may result in inefficient bit allocation.

Meanwhile, as in the related art, a case where processing for encoding an entire band of an input signal spectrum using transform coding like in a core coding section will be considered.

Figure 19:
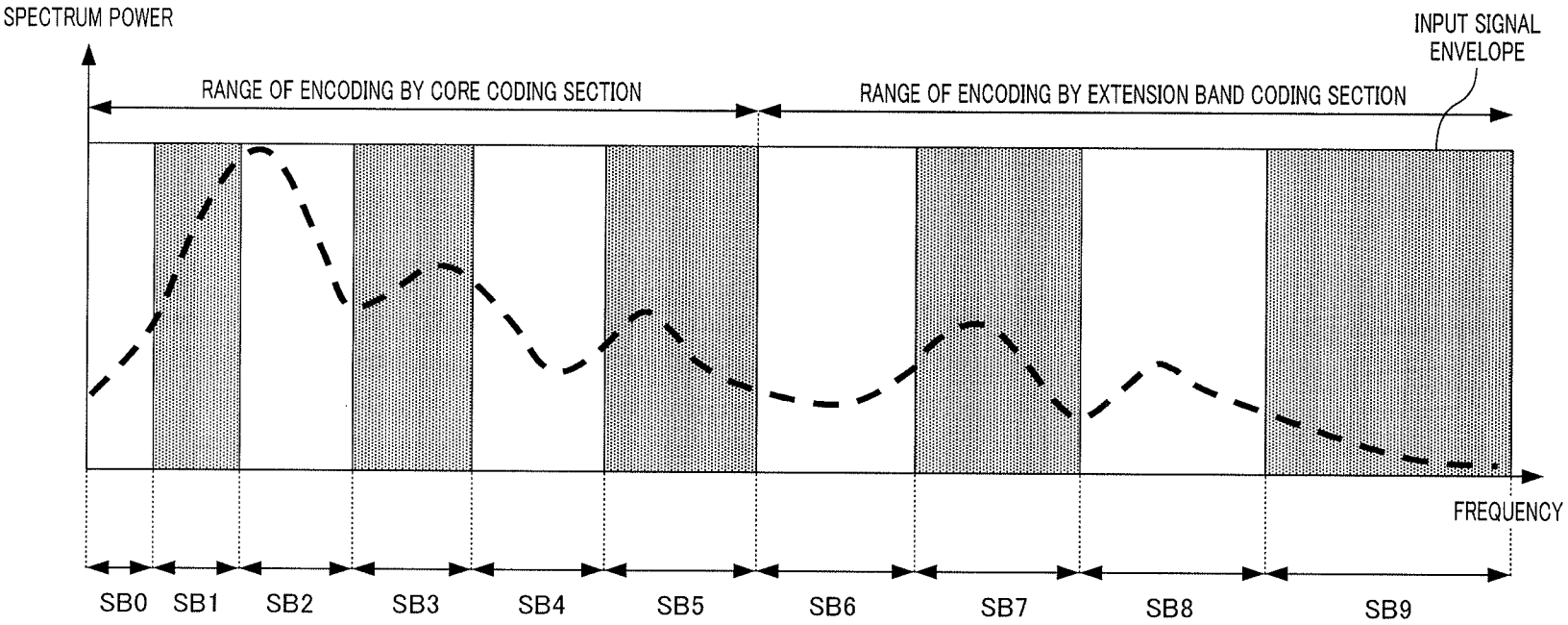
FIG. 19 is a diagram illustrating how an input signal spectrum is divided into a plurality of sub-bands in a coding apparatus according to Embodiment 6 of the present invention.

FIG. 19 is a diagram illustrating division of an input signal spectrum into a plurality of sub-bands.

As illustrated in FIG. 19, in transform coding, generally, an input signal spectrum is divided into a plurality of sub-bands, and bits are allocated according to energy in each sub-band (sub-band energy). More specifically, a larger number of bits are allocated to a sub-band as the sub-band has larger sub-band energy, and a smaller number of bits are allocated to a sub-band as the sub-band has smaller sub-band energy. In FIG. 19, a configuration in which a sub-band in a lower band has a smaller width and a sub-band has a larger width as the sub-band is positioned in a higher band is employed. This configuration is related to a critical band width provided by modeling the human auditory sense characteristics, and since the lower band is considered more important for the sound quality, such configuration is intended to perform high-quality encoding by providing small sub-band widths in the low band to densely allocate bits to the low band.

If transform coding processing is performed on an input signal spectrum in such sub-band configuration, a large number of bits may be allocated to the extension band part depending on the characteristics of the extension band spectrum. In this case, since the sub-bands in the extension band part each have a large sub-band width, even if a large number of bits are allocated to the extension band part, only a small number of pulses can be provided for expressing the extension band spectrum. Also, as a result of a large number of bits being allocated to the extension band part, the number of bits allocated to the low band part is reduced, which causes sound quality deterioration.

Therefore, in the present embodiment, when an input signal spectrum is encoded using transform coding, if a large number of bits are allocated to the extension band part, the extension band spectrum is encoded in an extension band coding section and the low band spectrum is subjected to transform coding processing. On the other hand, when an input signal spectrum is encoded using transform coding, if only a small number of bits are allocated to the extension band part, an entire band of the input signal spectrum is subjected to encoding processing using transform coding. Such switching of coding methods is made on a frame-by-frame basis.

The present embodiment provides the following effects. When an input signal spectrum is encoded using transform coding, if a large number of bits are allocated to the extension band part, switching is made so that the extension band spectrum is encoded by an extension band coding section to efficiently perform the encoding using a small number of bits, whereby encoding for the extension band can be performed using a bit count that is smaller than a bit count that would be consumed for the extension band if transform coding is employed for the entire band, and the resulting extra bits are re-allocated to the low band part. Consequently, noisiness occurred in the low band part are reduced as well as a feeling of an extensive bandwidth is maintained by extension band coding, which in turn, enables sound quality enhancement.

The present embodiment will be described taking, as an example, a configuration in which the total number of bits to be allocated to sub-bands in the extension band when an entire input signal spectrum is encoded by a core layer coding section and the number of bits to be consumed when the extension band spectrum is encoded by the extension band coding section are compared. A detailed description of the embodiment will be described below.

Figure 20:
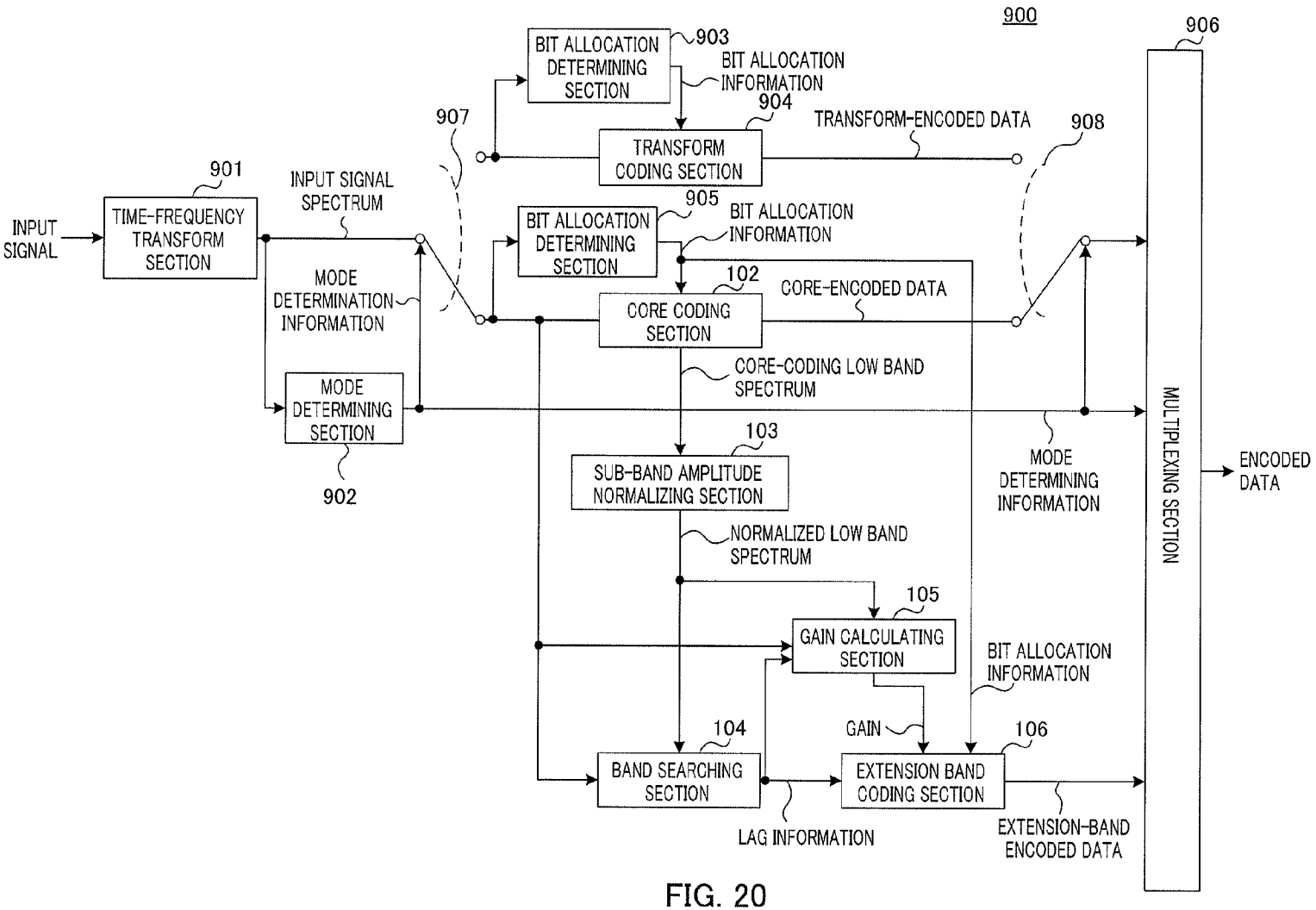
FIG. 20 is a block diagram illustrating a configuration of the coding apparatus according to Embodiment 6 of the present invention.

FIG. 20 is a block diagram illustrating a configuration of coding apparatus 900 according to Embodiment 6. In FIG. 20, components that overlap with those in FIG. 1 are provided with symbols that are the same as those in FIG. 1, and a description thereof will be omitted.

The present embodiment is configured so that switching is made between a case where an entire input signal spectrum is encoded by transform coding section 904 (hereinafter referred to as "transform coding mode") and a case where encoding is performed using a combination of core coding section 102 and extension band coding section 106 as in Embodiment 1 (hereinafter referred to as "extension coding mode"). A detailed description of operation of each component will be provided below.

Time-frequency transform section 901 transforms an input time-domain input signal (including a speech signal or/and a music signal) into a frequency-domain signal and outputs the resulting input signal spectrum to mode determining section 902, bit allocation determining section 903 and transform coding section 904 or outputs the input signal spectrum to mode determining section 902, bit allocation determining section 905 and core coding section 102. Here, the below description will be given on the premise that MDCT is employed for time-frequency transform processing in time-frequency transform section 901. However, the time-frequency changing section may use an orthogonal transform such as FFT (fast Fourier transform) or DCT (discrete cosine transform) for transform from the time domain to the frequency domain.

Mode determining section 902 determines a mode for encoding an input signal spectrum input from time-frequency transform section 901 for each frame, using the input signal spectrum. Mode determining section 902 outputs information on the determination to switch 907, switch 908 and multiplexing section 906 as mode determination information. Details of the operation will be described later.

Switch 907 switches coding modes using the mode determination information input from mode determining section 902. Switch 907 connects time-frequency transform section 901, and transform coding section 904 if the mode determination information indicates "0," and connects time-frequency transform section 901 and core coding section 102 if the mode determination information indicates "1."

If the mode determination information indicates "0," bit allocation determining section 903 outputs information representing the number of bits to be allocated to each sub-band of the input signal spectrum that is received as input from time-frequency transform section 901 (bit allocation information) to transform coding section 904, using the input signal spectrum. A detailed description of bit allocation determining section 903 will be described later.

Transform coding section 904 performs transform coding processing of the input signal spectrum received as input from time-frequency transform section 901 based on the bit allocation information received as input from bit allocation determining section 903 to generate transform-encoded data. Then, transform coding section 904 outputs the transform-encoded data to multiplexing section 906.

If the mode determination information indicates "1," the operation is performed in the extension coding mode. First, bit allocation determining section 905 outputs information representing the number of bits to be allocated to each sub-band of the low band spectrum and extension band coding section 106 (bit allocation information) to core coding section 102 and extension band coding section 106 using the input signal spectrum received as input from time-frequency transform section 901. A detailed description of bit allocation determining section 905 will be described later. Subsequently, core coding section 102 encodes the low band spectrum using the bit allocation information output from bit allocation determining section 905 and the input signal spectrum received as input from time-frequency transform section 901, and extension band coding section 106 encodes the extension band spectrum also using the bit allocation information output from bit allocation determining section 905 and the input signal spectrum received as input from time-frequency transform section 901.

In cooperation with switch 907, switch 908 connects transform coding section 904 and multiplexing section 906 if the mode determination information received as input from mode determining section 902 indicates "0" and connects core coding section 102 and multiplexing section 906 if the mode determination information indicates "1."

Multiplexing section 906 multiplexes the transform-encoded data input from transform coding section 904 and the mode determination information received as input from mode determining section 902 or multiplexes core-encoded data received as input from core coding section 102, extension-band encoded data received as input from extension band coding section 106 and the mode determination information received as input from mode determining section 902, and outputs the resulting encoded data.

Next, a detailed description of bit allocation determining section 903 and bit allocation determining section 905 will be provided.

Here, bit allocation determining section 903 allocates a large number of bits to sub-bands having large energy in the input signal spectrum and a small number of bits to sub-bands having small energy in the input signal spectrum. For example, the bits are allocated to the sub-bands according to Equation 3.

[3]

$$B_{sub}[j] = \frac{B_{total}}{N} + \frac{1}{2}\log_2\left(\frac{E[j]}{\sqrt[N]{\prod_{k=1}^{N} E[k]}}\right),\ 1 \le j \le N \qquad \text{(Equation 3)}$$

Here, $B_{sub}$ represents the number of bits to be allocated to each sub-band, N represents the total number of sub-bands in an input signal spectrum, $B_{total}$ represents the total number of bits that can be allocated for encoding of the input signal spectrum, E represents energy in each sub-band, and j represents an index indicating a sub-band.

As described above, the number of bits to be allocated to each sub-band is determined according to the magnitude of the energy of the sub-band relative to an average sub-band energy value, and a large number of bits are allocated to sub-bands having large sub-band energy and a small number of bits are allocated to sub-bands having small sub-band energy.

Meanwhile, bit allocation determining section 905 allocates bits to the sub-bands in the low band spectrum of the input signal and extension band coding section 106.

The allocation of bits to the sub-bands of the low band spectrum is performed as in bit allocation determining section 903. For example, the bit allocation is performed according to Equation 4.

[4]

$$B_{sub}[j] = \frac{B_{total} - B_{SWB}}{S} + \frac{1}{2}\log_2\left(\frac{E[j]}{\sqrt[S]{\prod_{k=1}^{S} E[k]}}\right),\quad 1 \le j \le S \qquad \text{(Equation 4)}$$

Here, S represents the total number of sub-bands in the low band spectrum and $B_{SWB}$ represents the number of bits to be allocated to extension band coding section 106.

In Equations 3 and 4, if the number of bits to be allocated to a sub-band has a negative value, the number of bits to be allocated to the sub-band is forcibly set to zero.

For bit count $B_{SWB}$ of bits to be allocated to extension band coding section 106, a value designed in advance is used. For example, if the total number of bits that can be used for encoding is 12 kbps, and 10 kbps in the total number of bits are allocated to core coding section 102, 2 kbps is allocated to extension band coding section 106. For example, if the frame length is 20 milliseconds, bit count $B_{SWB}$ of bits to be allocated to extension band coding section 106 for one frame is 2,000×0.02=40 bits.

Next, details of mode determining section 902 will be described with reference to FIG. 21.

Figure 21:
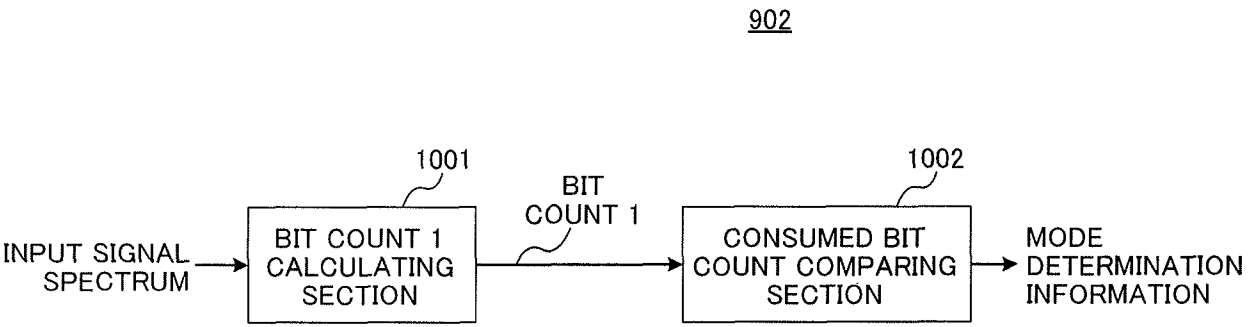
FIG. 21 is a diagram illustrating a configuration of a mode determining section in the coding apparatus according to Embodiment 6 of the present invention.

FIG. 21 is a diagram illustrating a configuration of mode determining section 902.

Mode determining section 902 calculates the number of bits to be required for encoding of an extension band spectrum in each of coding modes for an input signal spectrum and compares counts of bits to be consumed to make a determination.

Bit count 1 calculating section 1001 calculates the total number of bits to be allocated to the extension band part in the transform coding mode. First, bits are allocated to each sub-band of the input signal spectrum. The bit allocation in this case is performed in such a manner as in bit allocation determining section 903, and a description thereof will be omitted. Bit count 1 calculating section 1001 calculates the total number of bits allocated to the sub-bands in the extension band part from among the bits allocated to the sub-bands and outputs the total number of bits to consumed bit count comparing section 1002 as bit count 1.

Consumed bit count comparing section 1002 compares the total number of bits to be allocated to the sub-bands in the extension band part, which has been calculated by the bit count 1 calculating section 1001, and consumed bit count $B_{SWB}$ of bits to be consumed in the extension band coding section in the extension coding mode, and outputs a result of the comparison as mode determination information. For example, if bit count 1>$B_{SWB}$, mode determination information of "1" is output to switch 907, switch 908 and multiplexing section 906, and in cases other than the above case, mode determination information of "0" is output to switch 907, switch 908 and multiplexing section 906.

Figure 22:
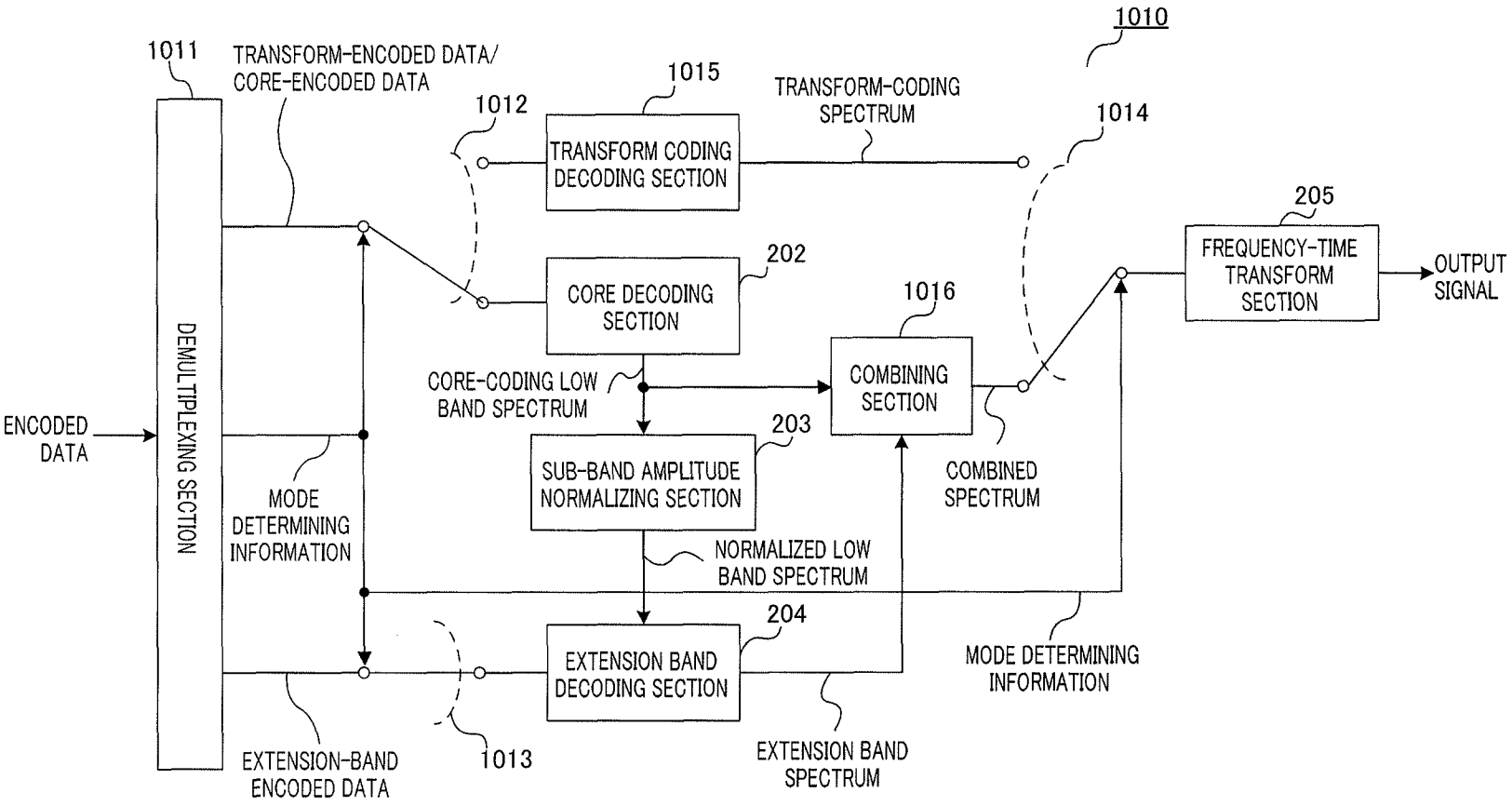
FIG. 22 is a block diagram illustrating a configuration of a decoding apparatus according to Embodiment 6 of the present invention.

Next, a decoding apparatus according to the present embodiment will be described. FIG. 22 is a block diagram illustrating a configuration of decoding apparatus 1010 according to the present embodiment. In FIG. 22, components that overlap with those in FIG. 3 are provided with symbols that are the same as those in FIG. 3, and a description thereof will be omitted.

Demultiplexing section 1011 demultiplexes input encoded data into mode determination information and transform-encoded data, or demultiplexing section 1011 demultiplexes input encoded data into mode determination information, core-encoded data and extension-band encoded data. Demultiplexing section 1011 outputs the mode determination information to switch 1012, switch 1013 and switch 1014. Also, demultiplexing section 1011 outputs the transform-encoded data to transform coding decoding section 1015 if the mode determination information indicates "0," and outputs the core-encoded data to core decoding section 202 if the mode determination information indicates "1," and further outputs the extension-band encoded data to extension band decoding section 204 if the mode determination information indicates "1."

Switch 1012 connects demultiplexing section 1011 and transform coding decoding section 1015 if the mode determination information received as input from demultiplexing section 1011 indicates "0," and connects demultiplexing section 1011 and core decoding section 202 if the mode determination information indicates "1."

In cooperation with switch 1012, switch 1013 does not connect demultiplexing section 1011 and extension band decoding section 204 if the mode determination information received as input from demultiplexing section 1011 indicates "0," but connects demultiplexing section 1011 and extension band decoding section 204 if the mode determination information indicates "1."

Transform coding decoding section 1015 performs processing for decoding the transform-encoded data received as input from demultiplexing section 1011 to generate a transform-coding spectrum, and outputs the transform-coding spectrum to switch 1014.

Core decoding section 202 performs processing for decoding the core-encoded data input from demultiplexing section 1011 to generate a core-coding low band spectrum and outputs the core-coding low band spectrum to sub-band amplitude normalizing section 203 and combining section 1016.

Extension band decoding section 204 performs decoding processing using the extension-band encoded data input from demultiplexing section 1011 and a normalized low band spectrum input from sub-band amplitude normalizing section 203 if the mode determination information indicates "1" to generate an extension band spectrum, and outputs the extension band spectrum to combining section 1016.

Combining section 1016 combines the core-coding low band spectrum input from core decoding section 202 and the extension band spectrum received as input from extension band decoding section 204 to generate a combined spectrum, and outputs the combined spectrum to switch 1014.

In cooperation with switch 1012, switch 1014 connects transform coding decoding section 1015 and frequency-time transform section 205 if the mode determination information input from demultiplexing section 1011 indicates "0," and connects combining section 1016 and frequency-time transform section 205 if the mode determination information indicates "1."

Frequency-time transform section 205 performs an orthogonal transform of the transform-coding spectrum input from transform coding decoding section 1015 or the combined spectrum input from combining section 1016 into a time-domain signal, and outputs the time-domain signal as an output signal.

By means of the configuration and operation described above, coding apparatus (FIG. 20) switches between coding methods for an input signal spectrum according to the characteristics of the extension band spectrum so that the extension band spectrum is encoded using a smaller number of bits. Consequently, a large number of bits can be allocated to the low band spectrum, enabling sound quality enhancement.

Embodiment 7

In the coding apparatus in FIG. 20, a coding method in which an extension band spectrum is encoded using a small number of bits is selected to allocate a large number of bits to a low band part, thus providing sound quality enhancement. However, in the case of encoding at a low bit rate, even if a coding method in which an extension band spectrum is encoded using a smaller consumed amount of bits is selected, an increased amount of bits allocated to a low band part is very small. Accordingly, in order to improve the sound quality of the low band part using a small number of bits, it is necessary to efficiently allocate bits to the low band part.

Therefore, in the present embodiment, the configuration in which a method of allocating bits to an input signal spectrum is switched to another along with switching of a coding method to be employed for encoding of the extension band spectrum is employed. More specifically, in the case of the transform coding mode, in order to achieve a sound quality providing a feeling of an extensive bandwidth, bits are allocated so that the bits are arranged in a wide band.

Meanwhile, in the case of the extension coding mode, bits are allocated only to sub-bands having large energy from among sub-bands in a low band part spectrum. As a result of bit allocation is performed only for sub-band having large energy, enabling reduction of noisiness in the low band part in a core coding section.

Here, in the case of the transform coding mode, also, noisiness in the low band part can be reduced by bit allocation being performed only for sub-bands having large energy; however, in this case, a feeling of an extensive bandwidth is lost because the number of bits allocated to sub-bands in an extension band coding section is reduced. However, in the case of the extension coding mode, even if destinations of bit allocation are limited to sub-bands having large energy in a low band spectrum, a high-quality extension band spectrum can be generated by the extension band coding section, enabling prevention of the problem of loss of a feeling of an extensive bandwidth. Also, extra bits generated as a result of employment of the extension band coding section are allocated to the low band part, enabling reduction in noisiness occurring in the low band part.

Therefore, the present embodiment enables provision of a sound quality with noisiness suppressed and providing a feeling of an extensive bandwidth.

A coding apparatus according to the present embodiment employs a configuration that is similar to that of the coding apparatus (FIG. 20) according to Embodiment 6. Therefore, components that overlap with those in FIG. 20 are provided with symbols that are the same as those in FIG. 20, and a description thereof will be omitted. However, bit allocation determining section 903 and bit allocation determining section 905 each operate in a manner that is different from those in Embodiment 6, and thus, details thereof will be described below.

While bit allocation determining section 903 allocates a large number of bits to sub-bands having large energy in an input signal spectrum and a small number of bits to sub-band having small energy in the input signal spectrum, in order to prevent loss of a feeling of an extensive bandwidth, bit allocation is performed so that bits are widely arranged through the overall input signal spectrum. For example, bit allocation to each sub-band is performed according to Equation 5.

[5]

$$B_{sub}[j] = \frac{B_{total}}{N} + \frac{1}{2}\log_2\left(\frac{E[j]}{\sqrt[N]{\prod_{k=1}^{N} E[k]}}\right),\ 1 \le j \le N \qquad \text{(Equation 5)}$$

Here, $B_{sub}$ represents the number of bits to be allocated to each sub-band, N represents a total number of sub-bands in an input signal spectrum, $B_{total}$ represents the total number of bits that can be allocated to the sub-bands, and j represents an index indicating a sub-band.

In Equation 5, if the number of bits to be allocated to a sub-band has a negative value, the number of bits to be allocated to the sub-band is forcibly set to zero.

Meanwhile, bit allocation determining section 905 arranges bits only in a low band spectrum in an input signal. However, here, in order to reduce noisiness in the low band part, bits are arranged only in sub-bands having large energy in a concentrated manner. For example, bit allocation to each sub-band is performed according to Equation 6.

[6]

$$B_{sub}[j] = \begin{cases} \frac{B_{total} - B_{SWB}}{S} + \frac{1}{2}\log_2\left(\frac{E[j]}{\sqrt[S]{\prod_{k=1}^{S} E[k]}}\right), & \left(\text{if } \frac{1}{2}\log_2\left(\frac{E[j]}{\sqrt[S]{\prod_{k=1}^{S} E[k]}}\right) > 0\right) \\ 0 & \text{(else)}, \end{cases} \qquad \text{(Equation 6)}$$

$$1 \le j \le S$$

Here, S represents the total number of sub-bands in a low band spectrum, and E represents energy of each sub-band. In Equation 6, bit allocation to each sub-band is adaptively adjusted depending on the magnitude of the sub-band energy, and the number of bits to be allocated to sub-bands each having energy that is lower than a geometric average sub-band energy value is forcibly set to zero. In other words, bits are allocated to sub-bands having large energy, i.e., sub-band energy that is equal to or larger than the geometric average value in a concentrated manner.

In Equation 6, extra bits $B_{rest}$ resulting from forcibly setting the number of bits to be allocated to sub-bands having small sub-band energy to zero are further re-allocated according to the magnitude of the sub-band energy. For example, the re-allocation is performed according to Equation 7.

[7]

$$B'_{sub}[i] = \frac{B_{rest}}{M} + \frac{1}{2}\log_2\left(\frac{E[i]}{\sqrt[M]{\prod_{k=1}^{M} E[k]}}\right),\ 1 \le i \le M \qquad \text{(Equation 7)}$$

Here, $B'_{sub}[i]$ represents the number of additional bits to be re-allocated to each sub-band, M represents the total number of sub-bands to which bits have been allocated according to Equation 6, and i represents an index indicating a sub-band subject to re-allocation.

The configuration and operation of a decoding apparatus according to the present embodiment are similar to those of the decoding apparatus (FIG. 22) according to Embodiment 6, and thus, a description thereof will be omitted.

By means of the configuration and operation described above, the coding apparatus according to the present embodiment switches between coding modes according to the characteristics of an extension band spectrum of an input signal and changes bit allocation to an input signal spectrum along with the switching, thus enabling provision of a sound quality with noisiness limited and providing a feeling of an extensive bandwidth.

Embodiment 8

In Embodiment 4, a description has been given of a configuration in which switching between a method that determines a characteristic of an input signal for each frame and according to a result of the determination, performs normalization using a largest value in a spectrum included in a sub-band and a method that performs normalization using a spectrum power envelope is made to generate a normalized extension band spectrum. In the present embodiment, a configuration in which when normalization is performed using a spectrum power envelope, in order to avoid generation of abnormal noise attributable to an excessive peak of a spectrum, at least either processing for adding noise generated based on a random number to a core-coding low band spectrum or clipping processing for a generated normalized low band spectrum is used will be described.

A coding apparatus and a decoding apparatus according to the present embodiment share a common basic configuration with coding apparatus 700 and decoding apparatus 800 according to Embodiment 4, and the description will be provided with reference to FIGS. 14 and 15. However, in the present embodiment, processing in a spectrum envelope normalizing section is partially different from that in spectrum envelope normalizing section 702 in coding apparatus 700 according to Embodiment 4, and in order to indicate the difference, the spectrum envelope normalizing section is indicated by "spectrum envelope normalizing section 702*a*". Likewise, in the present embodiment, processing in a spectrum envelope normalizing section is partially different from that in spectrum envelope normalizing section 802 in decoding apparatus 800 according to Embodiment 4, and in order to indicate the difference, the spectrum envelope normalizing section is indicated by "spectrum envelope normalizing section 802*a*." Also, a configuration and operation of spectrum envelope normalizing section 802*a* are the same as those of spectrum envelope normalizing section 702*a* (which will be described later), and thus, a detailed description thereof will be omitted.

Figure 23:
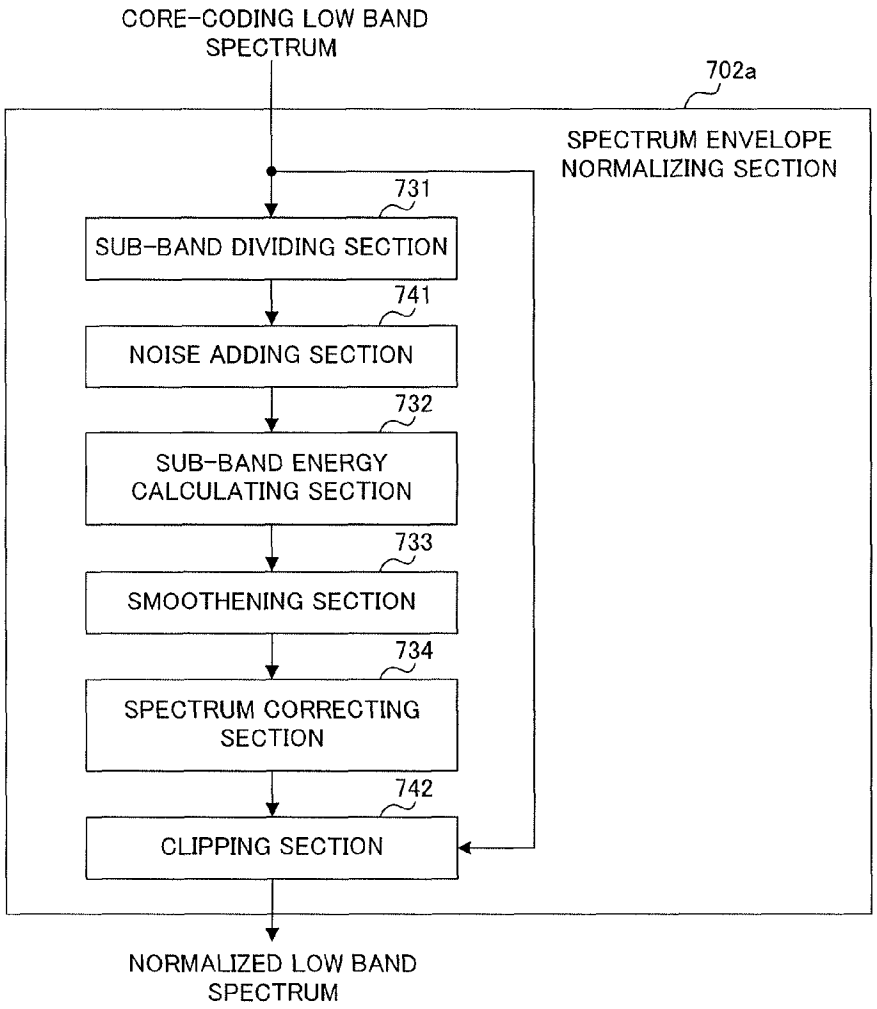
FIG. 23 is a block diagram illustrating an internal configuration of a spectrum envelope normalizing section in a coding apparatus according to Embodiment 8 of the present invention.

The configuration and operation of spectrum envelope normalizing section 702*a* according to the present embodiment will be described in detail with reference to FIG. 23. In FIG. 23, components that are the same as those in FIG. 16 are provided with reference numerals that are the same as those in FIG. 16, and a description thereof will be omitted here. More specifically, spectrum envelope normalizing section 702*a* illustrated in FIG. 23 includes noise adding section 741 and clipping section 742 in addition to the components of spectrum envelope normalizing section 702 illustrated in FIG. 16.

A core-coding low band spectrum that has been divided into sub-bands by sub-band dividing section 731 is input to noise adding section 741. Noise adding section 741 adds noise generated based on a random number to the core-coding low band spectrum. Noise adding section 741 performs the following processing for each sub-band. For example, noise adding section 741 determines whether or not there is any frequency in a sub-band at which an amplitude value of a core-coding low band spectrum part is zero, and if any, noise adding section 741 adds noise generated based on a random number to the frequency.

In this case, noise adding section 741 adds larger noise as the degree of a peak in the spectrum in the sub-band is larger. For an example of a specific noise addition method, noise adding section 741 calculates a range in which amplitude values of spectrum parts are no zero in a sub-band and adds smaller noise as the range is larger. Also, noise adding section 741 adds larger noise as a largest value in absolute value of a spectrum in a sub-band is larger. Noise to be added based on the range in which amplitude values of spectrum parts are not zero and the largest value in absolute value of the spectrum is expressed by, for example, Equation 8.

[8]

$$\mathrm{no}[i_{fzero}] = \mathrm{rand_val} * \frac{\mathrm{max_peak}}{cnt + 1} \qquad \text{(Equation 8)}$$

Here, no represents noise to be added, $i_{fzero}$ represents an index indicating a frequency at which an amplitude value of a spectrum part is zero, rand_val represents a random number between −1.0 to 1.0, max_peak represents a largest value in absolute value of the spectrum in a sub-band, and cnt represents a range in which amplitudes of spectrum parts are not zero.

Noise adding section 741 outputs the core-coding low band spectrum subsequent to the noise addition processing to sub-band energy calculating section 732.

Clipping section 742 performs clipping processing on a spectrum (normalized low band spectrum) output from spectrum correcting section 734. Clipping processing refers to processing for comparing between a predetermined threshold and the absolute value of the spectrum, and if the absolute value of the spectrum exceeds the threshold, replacing an amplitude value of the spectrum with the threshold. In other words, the amplitude value of the spectrum output from spectrum correcting section 734 is made to be equal to or smaller than the threshold by the clipping processing in clipping section 742.

The predetermined threshold may adaptively be determined for each frame. Also, a value obtained by calculating an average value in absolute value of a spectrum for an entire band or each sub-band of a core-coding low band spectrum and multiplying the average value by a predetermined value may be used as the threshold. If 1.0 is used for the predetermined value, the average value in absolute value of the spectrum is the threshold. Furthermore; the value by which the average value is multiplied may adaptively be changed. As an example, arrangement may be made so that a ratio of a largest value in the absolute values of the spectrum parts in the entire band or each sub-band of the core-coding low band spectrum relative to a total sum of the absolute values of the amplitudes of the spectrum parts in the entire band or each sub-band is determined, and if the ratio is large, the value by which the average value is multiplied is made to be large and if the ratio is small, the value by which the average value is multiplied is made to be small.

As described above, according to the present embodiment, when normalization is performed using a spectrum power envelope, noise adding section 741 adds noise to a core-coding low band spectrum or clipping section 742 performs clipping processing on the spectrum to reduce an intensity of a peak in a normalized low band spectrum to be generated by spectrum envelope normalizing section 702*a*, enabling sound quality deterioration due to an excessive peaking property to be avoided.

The embodiments of the present invention have been described above.

In the above embodiments, it is possible that sub-band amplitude normalizing section (103, 203, 501, 601) may make all amplitudes of components of a spectrum generated by transform coding the same, instead of normalizing the spectrum using absolute values of the amplitudes. However, in this case, the polarities of the spectrum parts are preserved. This processing enables reduction in processing amount, and causes no spectrum amplitude variations, enabling further reduction of abnormal sounds.

Although the decoding apparatus according to each of the above embodiments performs processing using coding information transmitted from the coding apparatus according to the embodiment, the present invention is not limited to such case, and the coding information does not have to be always coding information from the coding apparatus according to the embodiment, and the processing can be performed using any coding information containing necessary parameters or data.

The present invention is not limited to the embodiments described above, and various modifications are possible. For example, the embodiments described above may be implemented in combination.

In addition, the present invention can be applied in a case where the signal processing program is recorded and written to a machine readable recording medium such as a memory, disk, tape, CD, and DVD, and operated therein. The same effects as those obtained in the embodiments described above can be obtained in this case as well.

Moreover, the present invention is described with a case where the present invention is implemented as hardware.

However, the present invention can be achieved through software in concert with hardware.

Moreover, the functional blocks described in the embodiments are achieved by LSI, which is typically an integrated circuit. The functional blocks may be provided as individual chips, or part or all of the functional blocks may be provided as a single chip. Depending on the level of integration, the LSI may be referred to as an IC, a system LSI, a super LSI, or an ultra LSI.

In addition, the circuit integration is not limited to LSI and may be achieved by dedicated circuitry or a general-purpose processor other than an LSI. After fabrication of LSI, a field programmable gate array (FPGA), which is programmable, or a reconfigurable processor which allows reconfiguration of connections and settings of circuit cells in LSI may be used.

Should a circuit integration technology replacing LSI appear as a result of advancements in semiconductor technology or other technologies derived from the technology, the functional blocks could be integrated using such a technology. Another possibility is the application of biotechnology and/or the like.

The disclosures of Japanese Patent Applications No. 2011-197295, filed on Sep. 9, 2011, No. 2011-279623, filed on Dec. 21, 2011, No. 2012-019004, filed on Jan. 31, 2012, and No. 2012-079682, filed on Mar. 30, 2012, including the specifications, drawings and abstracts, are incorporated herein by reference in their entirety.

INDUSTRIAL APPLICABILITY

The present invention enables enhancement in quality of a decoded signal when a spectrum in an extension band is encoded using a spectrum in a low band part, and can be applied to packet communication systems and mobile communication systems, for example.

REFERENCE SIGNS LIST

100, 300, 500, 700, 900 Coding apparatus
101, 901 Time-frequency transform section
102 Core coding section
103, 203, 501, 601 Sub-band amplitude normalizing section
104 Band searching section
105 Gain calculating section
106 Extension band coding section
107, 906 Multiplexing section
131 Sub-band dividing section
132 Largest value searching section
133 Amplitude normalizing section
200, 400, 600, 800, 1010 Decoding apparatus
201, 1011 Demultiplexing section
202 Core decoding section
204 Extension band decoding section
205 Frequency-time transform section
301, 401, 503, 603 Harmonic emphasizing section
502, 602 Threshold controlling section
701, 801 Normalization method determining section
702, 702*a*, 802, 802*a* Spectrum envelope normalizing section
731 Sub-band dividing section
732 Sub-band energy calculating section
733 Smoothening section
734 Spectrum correcting section
902 Mode determining section
903, 905 Bit allocation determining section
904 Transform coding section
907, 908 Switch
1015 Transform coding decoding section

The invention claimed is:

1. A coding apparatus, comprising:

a memory that stores instructions;

a processor that executes the instructions;

a first coder that encodes a low band part of an input audio signal to generate first encoded data which is transmitted to a decoder side, the low band part being equal to or lower than a predetermined frequency; and a second coder;

wherein, when executed by the processor, the instructions cause the coding apparatus to perform operations comprising:

normalizing a first spectrum included in each of sub-bands obtained from dividing the low band part, using a largest amplitude value among the first spectrum included in each sub-band, and obtaining a first normalized low-frequency spectrum, the first spectrum being obtained by decoding the first encoded data;

calculating energy of the first spectrum in each of a plurality of the sub-bands obtained from dividing the low band part, smoothing the energy of the first spectrum in the sub-bands to obtain smoothened sub-band energy, and normalizing the first spectrum using the smoothened sub-band energy to generate a second normalized low-frequency spectrum;

selecting a first normalizer that obtains the first normalized low-frequency spectrum or a second normalizer that generates the second normalized low-frequency spectrum based on a feature value of the first spectrum obtained by decoding the first encoded data;

searching for a particular band where a value of correlation between a second spectrum and the first normalized low-frequency spectrum is highest among a plurality of candidate bands, the second spectrum being a spectrum in a high band part of the input audio signal that is higher than the predetermined frequency; and wherein the second coder encodes the second spectrum, and encodes information including an identifier of the particular band for transmitting the information to the decoder side, when the first normalizer is selected.

2. The coding apparatus according to claim 1, wherein the second normalizer adds noise to the first spectrum.

3. The coding apparatus according to claim 1, wherein the second normalizer performs clipping processing on the second normalized low-frequency spectrum.

4. A decoding apparatus, comprising:

a memory that stores instructions;

a processor that executes the instructions;

a first decoder that receives an input first encoded data generated by encoding a low band part of an input audio signal in a coding apparatus and that decodes the first encoded data to generate a first spectrum, the low band part being equal to or lower than a predetermined frequency; and a second decoder;

wherein, when executed by the processor, the instructions cause the decoding apparatus to perform operations comprising:

normalizing a first spectrum included in each of sub-bands obtained from dividing the low band part, using a largest amplitude value among the first spectrum included in each sub-band, and obtaining a normalized low-frequency spectrum, the first spectrum being obtained by decoding the first encoded data;

calculating energy of the first spectrum in each of a plurality of the sub-bands obtained from dividing the low band part, smoothing the energy of the first spectrum in the sub-bands to obtain smoothened sub-band energy, and normalizing the first spectrum using the smoothened sub-band energy to generate a normalized low-frequency spectrum;

selecting a first normalizer that normalizes the first spectrum or a second normalizer that calculates energy of the first spectrum based on a feature value of the first spectrum obtained by decoding the first encoded data;

wherein the second decoder receives as input the first normalized low-frequency spectrum or the second normalized low-frequency spectrum, and second encoded data generated in the coding apparatus, and decodes the second encoded data to generate a second spectrum, and wherein the second encoded data contains information indicating a particular band where a value of correlation is highest between an encoding-side second spectrum that is a spectrum in a high band part of the input audio signal that is higher than the predetermined frequency in the coding apparatus, and an encoding-side first spectrum that results from normalizing a spectrum generated by decoding the first encoded data in the coding apparatus.

5. A coding method, comprising:

encoding, using a first encoder of a coding apparatus, a low band part of an input audio signal to generate first encoded data which is transmitted to a decoder side, the low band part being equal to or lower than a predetermined frequency;

normalizing a first spectrum included in each of sub-bands obtained from dividing the low band part, using a largest amplitude value among the first spectrum included in each sub-band, and obtaining a first normalized low-frequency spectrum, the first spectrum being obtained by decoding the first encoded data;

calculating energy of the first spectrum in each of a plurality of the sub-bands obtained from dividing the low band part, smoothing the energy of the first spectrum in the sub-bands to obtain smoothened sub-band energy, and normalizing the first spectrum using the smoothened sub-band energy to generate a second normalized low-frequency spectrum;

selecting a first normalizer that obtains the first normalized low-frequency spectrum or a second normalizer that generates the second normalized low-frequency spectrum based on a feature value of the first spectrum obtained by decoding the first encoded data;

searching for a particular band where a value of correlation between a second spectrum and the first normalized low-frequency spectrum is highest among a plurality of candidate bands, the second spectrum being a spectrum in a high band part of the input audio signal that is higher than the predetermined frequency; and encoding, using a second coder of the coding apparatus, the second spectrum, and encoding information including an identifier of the particular band for transmitting the information to the decoder side, when the first normalizer is selected.

6. A decoding method, comprising:

receiving, at a first decoder of a decoding apparatus, an input first encoded data generated by encoding a low band part of an input audio signal in a coding apparatus, and decoding the first encoded data to generate a first spectrum, the low band part being equal to or lower than a predetermined frequency;

normalizing a first spectrum included in each of sub-bands obtained from dividing the low band part, using a largest amplitude value among the first spectrum included in each sub-band, and obtaining a first normalized low-frequency spectrum, the first spectrum being obtained by decoding the first encoded data;

calculating energy of the first spectrum in each of a plurality of the sub-bands obtained from dividing the low band part, smoothing the energy of the first spectrum in the sub-bands to obtain smoothened sub-band energy, and normalizing the first spectrum using the smoothened sub-band energy to generate a second normalized low-frequency spectrum;

selecting a first normalizer that obtains the first normalized low-frequency spectrum or a second normalizer that generates the second normalized low-frequency spectrum based on a feature value of the first spectrum obtained by decoding the first encoded data; and receiving as input, at a second decoder of the decoding apparatus, the first normalized low-frequency spectrum or the second normalized low-frequency spectrum, and second encoded data generated in the coding apparatus, and decoding the second encoded data to generate a second spectrum, wherein the second encoded data contains information indicating a particular band where a value of correlation is highest between an encoding-side second spectrum, that is a spectrum in a high band part of the input audio signal that is higher than the predetermined frequency in the coding apparatus, and an encoding-side first spectrum that results from normalizing a spectrum obtained by decoding the first encoded data in the coding apparatus.

* * * * *